US007118181B2

(12) United States Patent
Frear

(10) Patent No.: US 7,118,181 B2
(45) Date of Patent: Oct. 10, 2006

(54) CUTTING TOOL WEAR SLEEVES AND RETENTION APPARATUSES

(76) Inventor: Joseph K. Frear, 233 North St., Bedford, PA (US) 15522

( * ) Notice: Subject to any disclaimer, the term of this patent is extended or adjusted under 35 U.S.C. 154(b) by 0 days.

(21) Appl. No.: 10/917,084

(22) Filed: Aug. 12, 2004

(65) Prior Publication Data

US 2006/0033379 A1 Feb. 16, 2006

(51) Int. Cl.
*E21C 35/197* (2006.01)

(52) U.S. Cl. ..... 299/104; 299/107

(58) Field of Classification Search ..... 299/107, 299/104

See application file for complete search history.

(56) References Cited

U.S. PATENT DOCUMENTS

| | | | | |
|---|---|---|---|---|
| 630,176 | A | 8/1899 | Brown | |
| 1,044,299 | A | 11/1912 | Trundle | |
| 1,348,434 | A * | 8/1920 | Marshick | 373/101 |
| 1,871,839 | A | 8/1932 | Carter | |
| 2,353,561 | A | 7/1944 | Hassett | |
| 3,171,666 | A | 3/1965 | Benjamin et al. | |
| 3,320,575 | A | 5/1967 | Brown et al. | |
| 3,339,944 | A | 9/1967 | Poague | |
| 3,521,342 | A | 7/1970 | Van Dom et al. | |
| 3,527,120 | A | 9/1970 | Duer et al. | |
| 3,541,882 | A | 11/1970 | Testa | |
| 3,622,206 | A | 11/1971 | Krekeler | |
| 3,652,130 | A | 3/1972 | Elders | |
| 3,690,728 | A | 9/1972 | Krekeler | |
| 3,767,266 | A * | 10/1973 | Krekeler | 299/107 |
| 3,807,776 | A | 4/1974 | Bingham | |
| 3,865,437 | A | 2/1975 | Crosby | |
| 3,957,385 | A | 5/1976 | Ullberg | |
| 3,976,340 | A | 8/1976 | Pitner | |
| 3,980,325 | A | 9/1976 | Robertson | |
| 4,049,297 | A | 9/1977 | Reneau | |
| 4,084,856 | A | 4/1978 | Emmerich et al. | |
| 4,229,025 | A | 10/1980 | Volgstadt et al. | |
| 4,239,318 | A | 12/1980 | Schwartz | |
| 4,240,677 | A | 12/1980 | Payne et al. | |
| 4,323,727 | A | 4/1982 | Berg | |
| 4,349,050 | A * | 9/1982 | Bergstrom et al. | 138/147 |
| 4,367,053 | A | 1/1983 | Stratienko et al. | |
| 4,484,783 | A * | 11/1984 | Emmerich | 299/107 |

(Continued)

FOREIGN PATENT DOCUMENTS

DE 3712427 A1 * 10/1988

(Continued)

OTHER PUBLICATIONS

U.S. Appl. No. 10/886,207, Frear.

*Primary Examiner*—John Kreck
(74) *Attorney, Agent, or Firm*—Kirkpatrick & Lockhart Nicholson Graham LLP

(57) ABSTRACT

Cutting tool assemblies and wear and retention sleeves. The assemblies may include a support block that has a sleeve-receiving hole therethrough and a cutting tool that has an elongated shank. Various configurations of sleeves are disclosed for supporting the elongated shank of the cutting bit in the support block. Such sleeve embodiments may be provided with a plurality of axially extending overlapping notches to establish segments of various degrees of interference fit between the sleeve and the support block when seated in the sleeve-receiving hole of the support block. Some sleeve embodiments are configured to permit the shank of a cutting bit to freely rotate therein. Other sleeve embodiments are configured to prevent rotation of the cutting bit shank when inserted therein.

56 Claims, 31 Drawing Sheets

U.S. PATENT DOCUMENTS

| | | | | |
|---|---|---|---|---|
| 4,505,058 | A | 3/1985 | Peterson | |
| 4,575,156 | A | 3/1986 | Hunter et al. | |
| 4,575,456 | A * | 3/1986 | Hayes | 424/49 |
| 4,616,948 | A | 10/1986 | Jelfs | |
| 4,712,811 | A | 12/1987 | Wier | |
| 4,733,987 | A | 3/1988 | Tomlinson et al. | |
| 4,763,956 | A | 8/1988 | Emmerich | |
| 4,772,139 | A * | 9/1988 | Bretton | 384/537 |
| 4,813,808 | A | 3/1989 | Gehrke | |
| 4,828,327 | A | 5/1989 | Wechner | |
| 4,836,614 | A | 6/1989 | Ojanen | |
| 4,850,649 | A | 7/1989 | Beach et al. | |
| 4,915,455 | A | 4/1990 | O'Neill et al. | |
| 4,932,689 | A | 6/1990 | Bradley | |
| 4,944,560 | A | 7/1990 | Osterwise | |
| 4,979,911 | A | 12/1990 | Spencer | |
| 5,011,229 | A | 4/1991 | O'Neill et al. | |
| 5,088,797 | A | 2/1992 | O'Neill | |
| 5,106,166 | A | 4/1992 | O'Neill | |
| 5,302,005 | A | 4/1994 | O'Neill | |
| 5,354,068 | A | 10/1994 | Maleski | |
| 5,450,657 | A | 9/1995 | Georgopoulos et al. | |
| 5,725,283 | A | 3/1998 | O'Neill | |
| 5,816,627 | A * | 10/1998 | Readman | 285/340 |
| 5,931,542 | A | 8/1999 | Britzke et al. | |
| 6,095,713 | A | 8/2000 | Doyle et al. | |
| 6,357,832 | B1 | 3/2002 | Sollami | |
| 6,361,243 | B1 | 3/2002 | Geib | |
| 6,585,327 | B1 | 7/2003 | Sollami | |
| 6,623,084 | B1 | 9/2003 | Wasyleczko | |
| 6,648,514 | B1 | 11/2003 | Cevasco et al. | |
| 2004/0051370 | A1 | 3/2004 | Montgomery, Jr. | |

FOREIGN PATENT DOCUMENTS

| | | |
|---|---|---|
| DE | 19809344 | 6/1999 |
| DE | 10040562 A1 * | 3/2002 |
| DE | 100 40 562 C2 | 7/2002 |

* cited by examiner

CUTTING TOOL WEAR SLEEVES AND RETENTION APPARATUSES

BACKGROUND

1. Field of the Invention

Various embodiments of the subject invention relate to tool retainers and tool retainer systems and, more particularly, to wear and retention sleeves for supporting and retaining a cutting tool within a support member.

2. Description of the Invention Background

Over the years, man has designed a variety of different tools for cutting materials. One such tool is employed in the mining of underground materials such as coal and the like. The tools, commonly referred to as "cutting bits", are affixed to rotating cutting drums located on mining machines. As the cutting bits are advanced into the material to be mined, the cutting bits dislodge the material from the seam to enable it to be collected on a conveyor arrangement for removal from the mine. Each such cutting bits commonly has an elongated cylindrical shank portion that is received in a mounting block that is attached to the driven cutting drum. A replaceable cutting insert, fabricated from hardened material, is usually affixed to the end of the cutting bit. In many applications, wear sleeves are employed to support the cutting bit within the support member and to reduce the wear experienced by the support member resulting from continuous operation.

A variety of bit retainer methods and systems have been designed. Examples of such retainer arrangements are disclosed in U.S. Pat. No. 3,767,266 to Krekeler, U.S. Pat. No. 4,084,856 to Emmerich et al., U.S. Pat. No. 4,484,783 to Emmerich, U.S. Pat. No. 4,575,156 to Hunter et al., U.S. Pat. No. 4,836,614 to Ojanen, U.S. Pat. No. 4,850,649 to Beach et al., U.S. Pat. No. 5,088,797 to O'Neill, U.S. Pat. No. 5,302,055 to O'Neill, U.S. Pat. No. 5,725,283 to O'Neill, U.S. Pat. No. 6,357,832 to Sollami, and U.S. Pat. No. 6,623,084 to Wasyleczko.

FIGS. 1–5 illustrate a prior method of retaining a cutting bit 100 within its respective support member. The cutting bit 100 commonly includes a cutting tip or insert 102 that is attached to a conical portion 104. The cutting insert 102 is usually fabricated from hardened material and is attached to the end of the conical portion 104 by brazing or other conventional fastening methods. The cutting bit 100 further has an elongated shank 106 which is cylindrical in shape and designed to be supported in a tool holder block or support block 120 that is attached to a rotatable cutting drum 124 which is operably supported on a mining machine (not shown). As is common practice, when the rotating cutting bit 100 is brought into contact with the material to be mined, the cutting tip 102 of the cutting bit 100 dislodges the material from the seam to enable it to drop onto a conveying system for removal from the mine.

A flange 107 is formed on the end of the cutting bit shank 106. The flange 107 is sized to enable it to be inserted into a shank-receiving hole 122 in the support block 120. See FIG. 2. A retention sleeve 130 is placed over the shank 106 such that it extends between the flange 105 of the cutting bit 100 and the retainer flange 107. An axially extending slot 132 is provided in the sleeve 130 to permit the sleeve 130 to be installed on the shank 106. The retention sleeve 130 is commonly fabricated from steel. The cutting bit 100 is then typically installed into the support block 120 by hammering the end of the cutting bit to cause the shank 106 and sleeve 130 to be inserted into the shank-receiving hole 122 in the support block 120 until it is seated as shown in FIGS. 1 and 2.

Such prior retention sleeve arrangements can be difficult to install. In particular, to attain sufficient retention, prior retention sleeves must be sized in such a manner relative to the shank-receiving hole in the support block such that when they are fully inserted into the shank-receiving hole, a sufficient amount of retention forces are generated. Thus, when installing such prior bit and sleeve arrangements, the sleeve and bit assembly must be hammered into the shank-receiving hole. This requires the installer to support the shank and sleeve assembly adjacent the hole opening with one hand and strike the end of the bit with a hammer or other tool to force it into the shank-receiving hole. Often times the installation takes place in cramped quarters further complicating the installation process and exposing the installer to injury should the hammer inadvertently miss the bit and strike the installer's other hand that is supporting the bit adjacent the hole opening. Further, while being difficult to install, the retention forces (i.e., the amount of force required to press the sleeve and bit out of the hole in the support block) attained by such prior arrangements are not high (i.e., commonly on the order of 100 to 120 pounds).

Furthermore, when using many prior wear sleeve arrangements that are pressed fit into a bore in a support block, the diameter and the total roundness of the bore are critical. If the diameter of the bore is too small, the sleeve could only be installed with great difficulty, if at all. In extreme instances, a bore that was too small may actually result in the sleeve becoming deformed or otherwise damaged which could result in damage to the bit shank. Such arrangements may also be difficult to remove. In many prior arrangements, the support block is heat treated and then machined to attain a bore with a very precise diameter. Such processes can be expensive and time consuming.

SUMMARY

In accordance with one embodiment of the invention, there is provided a cutting tool assembly that includes a support block that has a sleeve-receiving hole therethrough. The assembly of this embodiment further includes a cutting tool that has an elongated shank and an annular sleeve that has a leading end and a trailing end. The annular sleeve further has at least one first notch that extends axially from a corresponding first notch opening at the leading end towards the trailing end. In addition, the sleeve further has at least one second opposing notch adjacent at least one first notch. Each second notch axially extends from a corresponding second notch opening at the trailing end towards the leading end. The first and second notches establish at least two discrete partially arcuate segments of interference fit between the sleeve and the support block when the annular sleeve is seated within the sleeve-receiving hole. The sleeve further has a shank-receiving passage that extends therethrough for rotatably supporting the elongated shank therein.

Another embodiment of the present invention comprises a cutting tool assembly that includes a support block that has a sleeve-receiving hole therethrough. The assembly further includes a cutting tool that has an elongated shank comprising a first shank portion that has a first diameter, a second shank portion that has a second diameter that is less than the first diameter of the first shank portion, and an end portion that has the first diameter. The end portion is oriented such that the second shank portion is between the first shank portion and the end portion. The assembly further includes an annular sleeve sized to be received on the second shank portion between the first shank portion and the end portion of the cutting tool. The annular sleeve further has a plurality of axially extending notches therein for establishing at least two discrete, partially arcuate segments of interference fit between the sleeve and the support block when the annular sleeve is seated within the sleeve-receiving hole. The annular sleeve is also sized to permit the second shank portion to rotate therein while retaining the elongated shank within the shank-receiving passage in the support block.

Another embodiment of the present invention comprises a cutting tool assembly that includes a support block that has a sleeve-receiving hole therethrough. The assembly further includes a cutting tool that has an elongated shank and an end portion. In addition, the assembly includes a sleeve that has a flange and a body portion that protrudes from the flange. The body portion has a plurality of axially extending notches therein for establishing at least two discrete partially arcuate segments of interference fit between the body portion and the support block when the body portion is seated within the sleeve-receiving hole. The body portion further has a shank-receiving passage for receiving the elongated shank therethrough. In addition, the body portion has a tapered retaining end for retainingly engaging the end portion of the elongated shank while permitting rotation of the elongated shank within the shank-receiving passage.

Another embodiment of the present invention comprises a cutting tool assembly that includes a support block that has a sleeve-receiving hole therethrough. The assembly further includes a cutting tool that has an elongated shank and an annular wear sleeve that has a plurality of axially extending notches therein for establishing at least two discrete partially arcuate segments of interference fit between the sleeve and the support block when the annular sleeve is seated within the sleeve-receiving hole. The annular sleeve further has a shank-receiving passage for receiving the elongated shank therethrough while permitting rotation of the elongated shank therein. A retention member is attachable to an end of the elongated shank to retain the elongated shank within the shank-receiving passage in the wear sleeve.

Another embodiment of the present invention comprises a cutting tool assembly that includes a support block that has a sleeve-receiving hole therethrough. The assembly further has a cutting tool that has an elongated shank and an annular wear sleeve. The wear sleeve includes at least two first notches that each extend axially from a corresponding first notch opening at the leading end of the sleeve towards the trailing end of the sleeve. The sleeve further has a second opposing notch that corresponds to each first notch and is axially aligned therewith to define a pair of axially aligned first and second notches. Each second notch extends from a corresponding second notch opening at the trailing end towards the corresponding first notch to define a central portion of the sleeve between the first and second axially aligned notches. The sleeve also includes a third notch between each pair of axially aligned first and second notches for establishing at least two discrete partially arcuate segments of interference fit between the annular wear sleeve and the support block when the annular wear sleeve is seated within the sleeve-receiving hole. The annular wear sleeve also includes a shank-receiving passage for rotatably receiving the elongated shank therethrough. A retention member is attachable to an end of the elongated shank to retain the elongated shank within the shank-receiving passage in the wear sleeve.

Another embodiment of the present invention comprises a wear sleeve for rotatably supporting a shank of a cutting tool within a support block. In one embodiment, the wear sleeve includes a body portion that has a leading end and a trailing end. The leading end has a flange formed thereon and the body portion has at least two first notches therein. Each first notch extends axially from the flange towards the trailing end. A second opposing notch that corresponds to each first notch is provided in the body portion. The second notches are aligned with the corresponding first notches to define a pair of axially aligned first and second notches. Each second notch extends from a corresponding second notch opening at the trailing end and further extends axially towards the corresponding first notch to define a central portion of the body portion therebetween. A third notch is provided in the body portion between each pair of axially aligned first and second notches for establishing at least two discrete partially arcuate segments of interference fit between the body portion and the support block when the body portion is seated within a sleeve-receiving hole in the support block. A shank-receiving passage is provided in the body portion for rotatably receiving the elongated shank therethrough. An outer flange that has a hole therethrough for receiving the body portion therethrough is also provided. The outer flange has a recess therein for receiving the flanged end of the body portion therein.

Those of ordinary skill in the art will readily appreciate that these and other details, features and advantages will become further apparent as the following detailed description of the preferred embodiments proceeds.

BRIEF DESCRIPTION OF THE DRAWINGS

In the accompanying Figures, there are shown present preferred embodiments of the invention wherein like reference numerals are employed to designate like parts and wherein.

DETAILED DESCRIPTION

Figure 1:
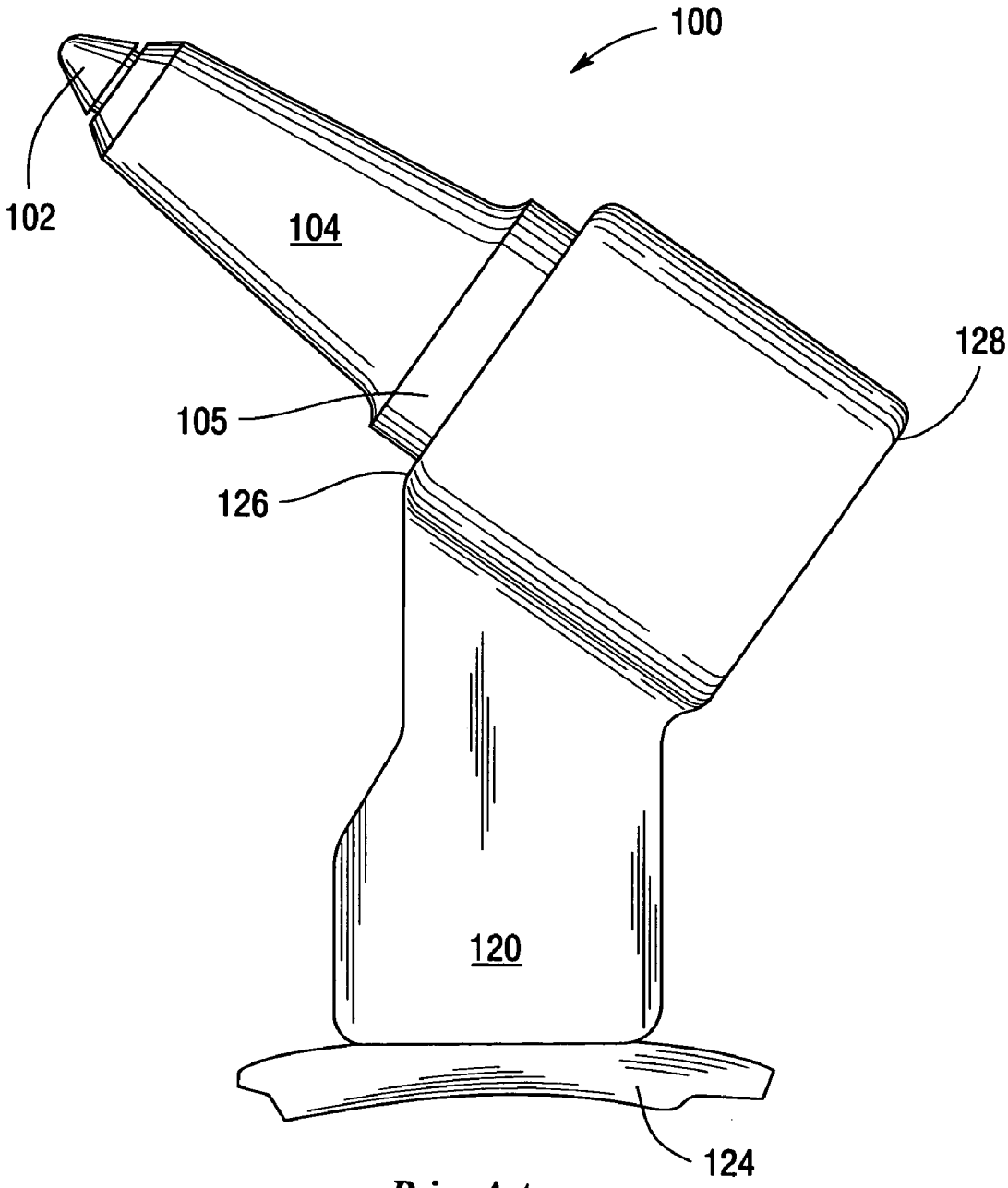
Prior Art Fig.1
FIG. 1 is a side view of a prior cutting bit attached to a support member affixed to a rotatable cutting drum of a mining machine.
Figure 2:
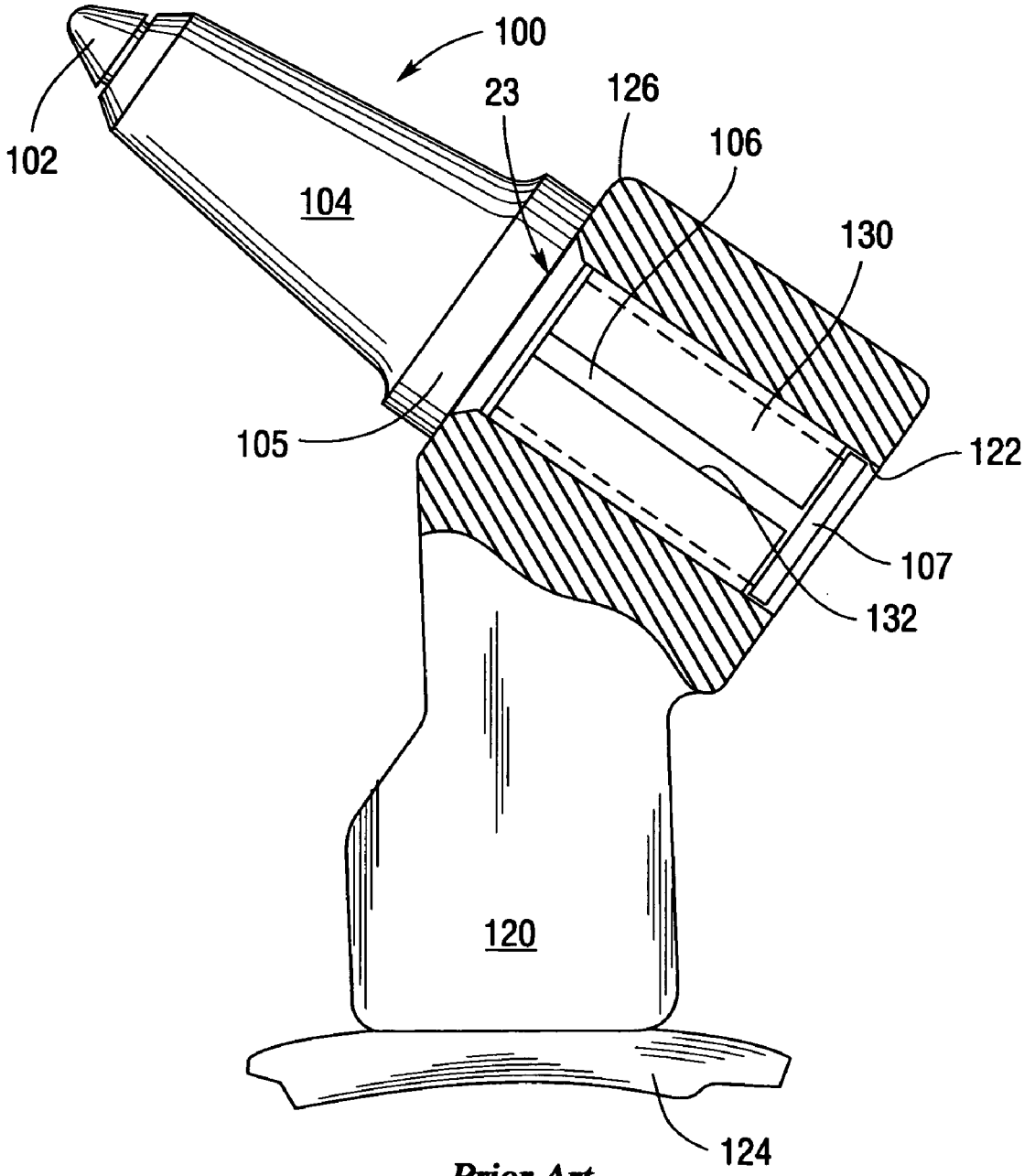
Prior Art Fig.2
FIG. 2 is a cross-sectional view of the prior cutting bit and support member arrangement of Figure with some elements shown in full view for clarity.
Figure 3:
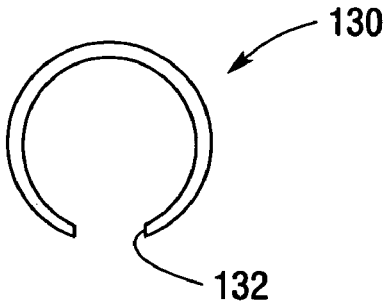
Prior Art Fig.3
FIG. 3 is a top view of a prior retention sleeve.
Figure 4:
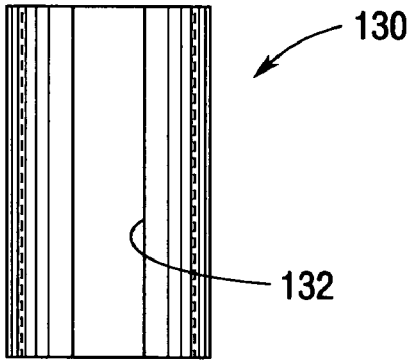
Prior Art Fig.4
FIG. 4 is a front elevation view of the sleeve of FIG. 3.
Figure 5:
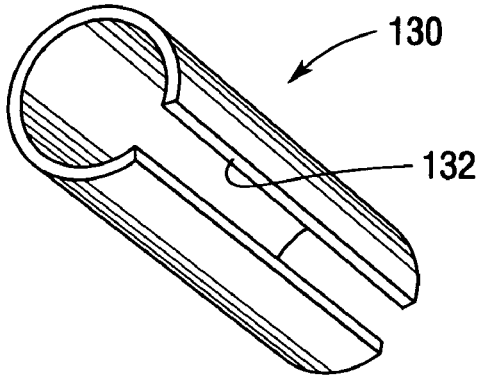
Prior Art Fig.5
FIG. 5 is a perspective view of the sleeve of FIGS. 3 and 4.

Referring now to the drawings for the purposes of illustrating embodiments of the invention only and not for the purposes of limiting the same, FIGS. 6–15 illustrate one retention sleeve embodiment of the present invention utilized to retain a cutting tool in the form of a conventional cutting bit 200 and or other sleeves associated with mining bits that may be commonly employed in connection with the mining of coal, minerals and the like. However, as the present Detail Description proceeds, the reader will appreciate that the various embodiments of the subject invention will find utility outside of the field of mining bits and the like. Various embodiments of the subject invention could be used with a variety of different cutting tools. For example, some, if not all, of the embodiments of the subject invention could be used in connection with cutting tools used to cut/grind road surfaces and the like. Thus, the scope of protection afforded to the various embodiments of the subject invention should not be limited solely to use with mining bits.

Figure 6:
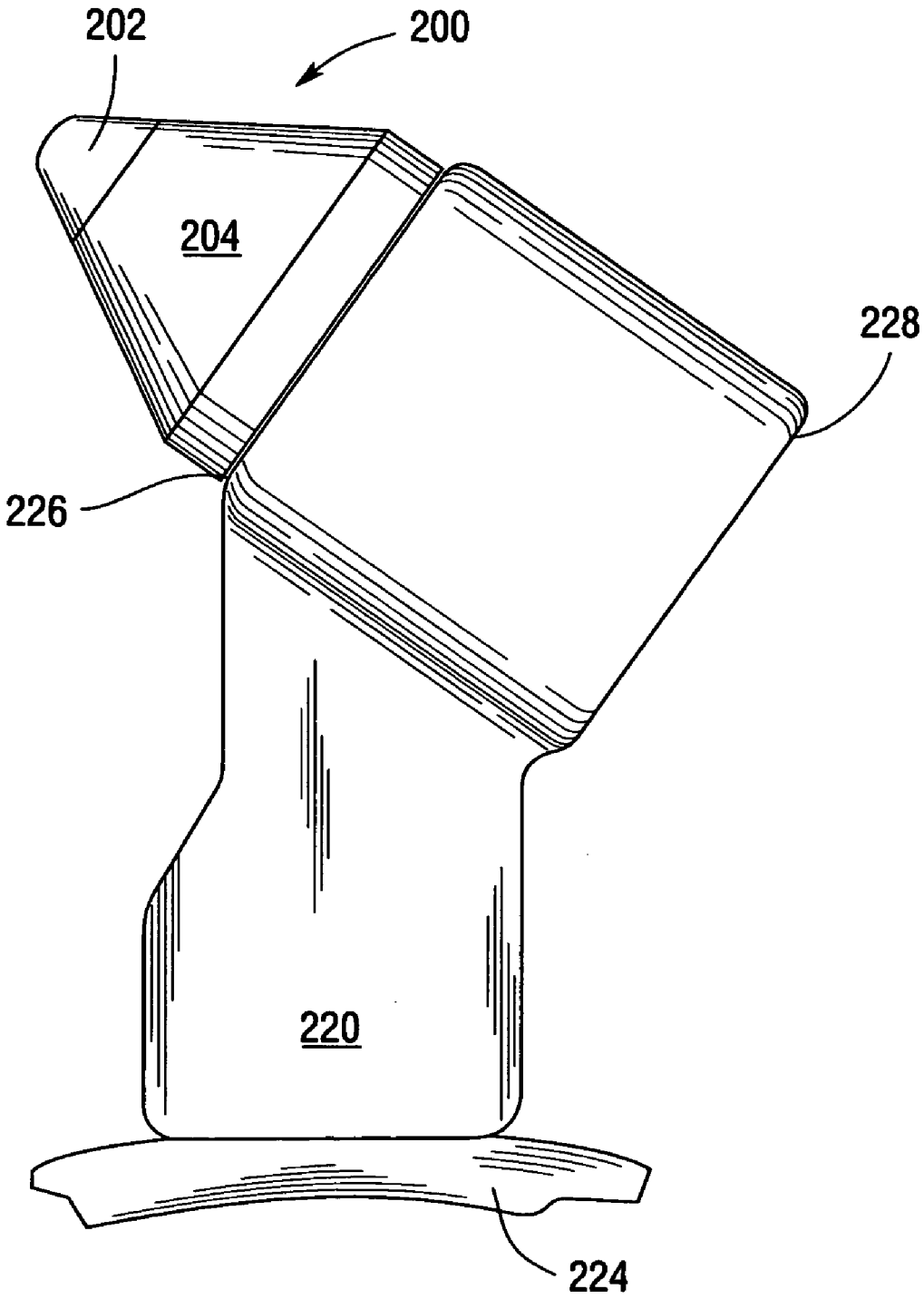
FIG. 6 is a side view of a cutting bit which may be attached to a support member utilizing a retention sleeve embodiment of the present invention.
Figure 7:
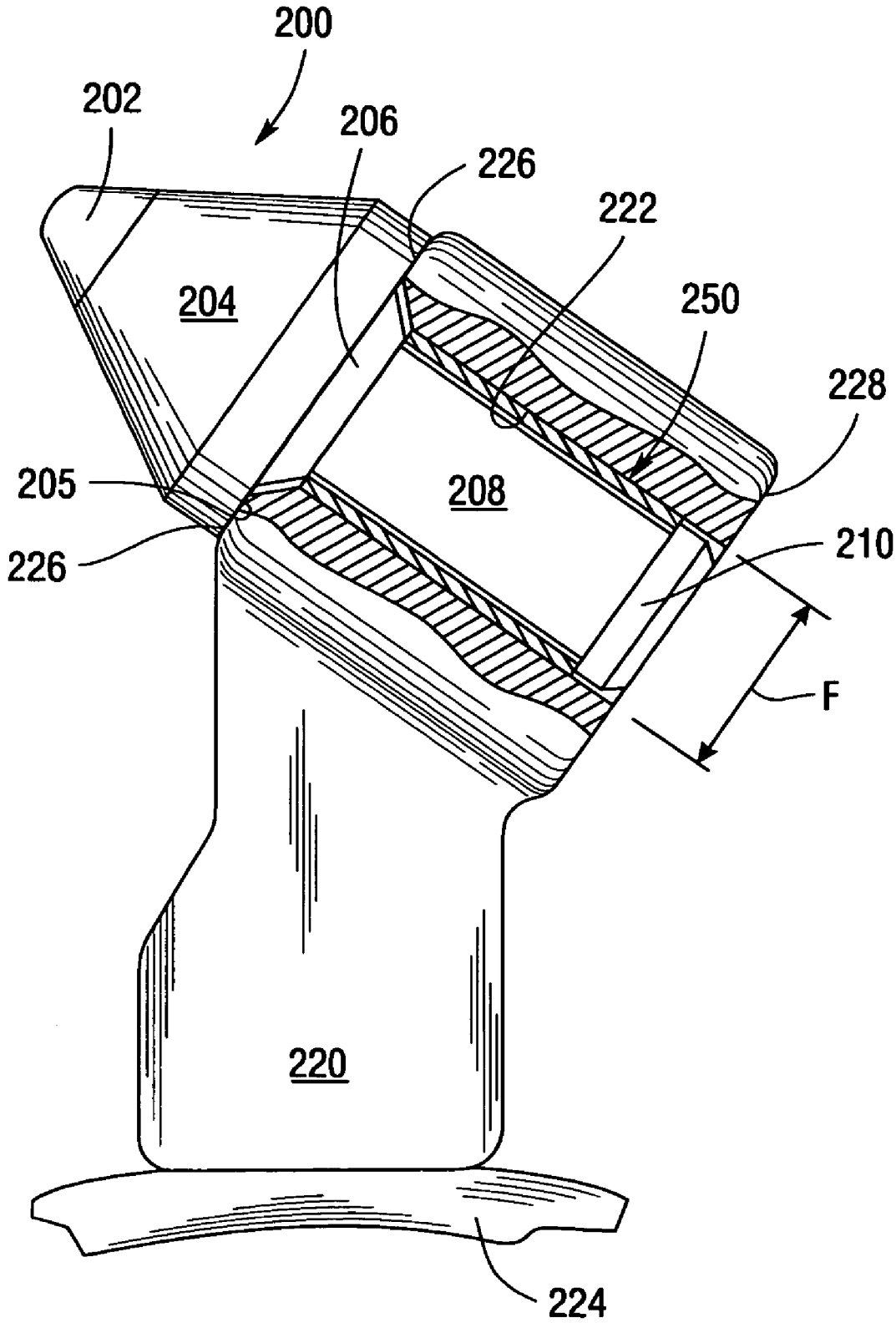
FIG. 7 is a partial cross-sectional view of the cutting bit and support block arrangement of FIG. 6.
Figure 8:
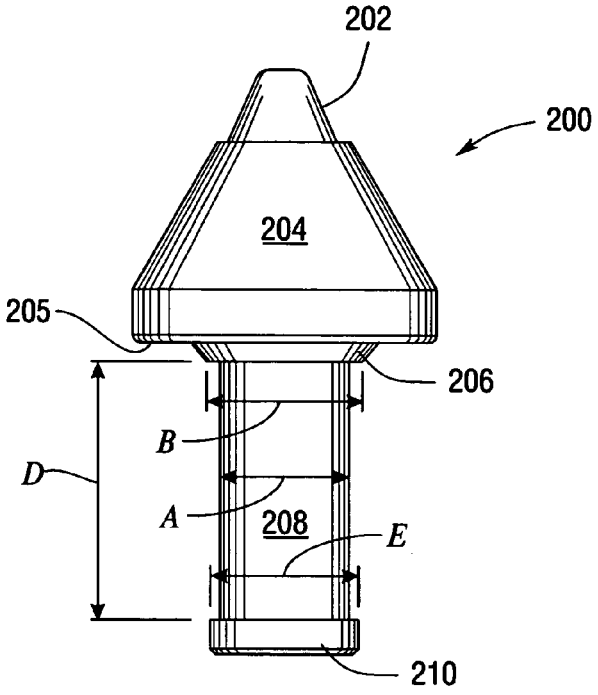
FIG. 8 is an elevational view of a cutting bit with which one or more sleeve embodiments of the present invention may be used.
Figure 14:
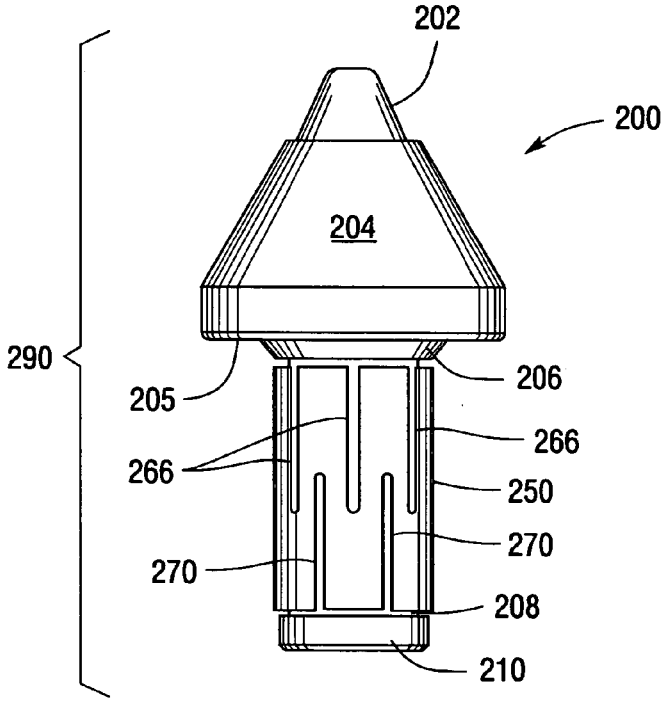
FIG. 14 is an elevational view of the sleeve of FIGS. 10–13 installed on a cutting bit of FIG. 8 to form one cutting bit assembly embodiment of the present invention.

More particularly and with reference to FIGS. 6–8, those Figures illustrate a cutting bit 200 that is retained within a sleeve-receiving hole 222 in a tool holder or support block 220. The support block 220 may have a front face 226 and a rear face 228 and be attached to rotating drum member 224 that is supported on a conventional mining machine. As can be seen in FIG. 8, the cutting bit 200 may include a cutting tip or insert 202 that is attached to a conical portion 204. The cutting insert 202 may be fabricated from hardened material (carbide or the like) and be attached to the end of the conical portion 204 by brazing or other conventional fastening methods. The conical portion 204 terminates in a contact face 205 that has a frusto-conical portion 206 protruding therefrom. An elongated shank 208 protrudes from the frusto-conical portion 206 and has a diameter "A" which may be less than the smallest diameter "B" of the frusto-conical portion 206. A retainer flange 210 is formed or otherwise provided on the end of the elongated shank 208. The elongated shank has a length "D" between the frusto-conical portion 206 and the retainer flange 210. Retainer flange 210 has a diameter "E" that is greater than the diameter "A" of the elongated shank 208 and less than the diameter "F" of the sleeve-receiving hole 222 in the support block 220 to enable the retainer flange 210 to be inserted therein.

Figure 9:
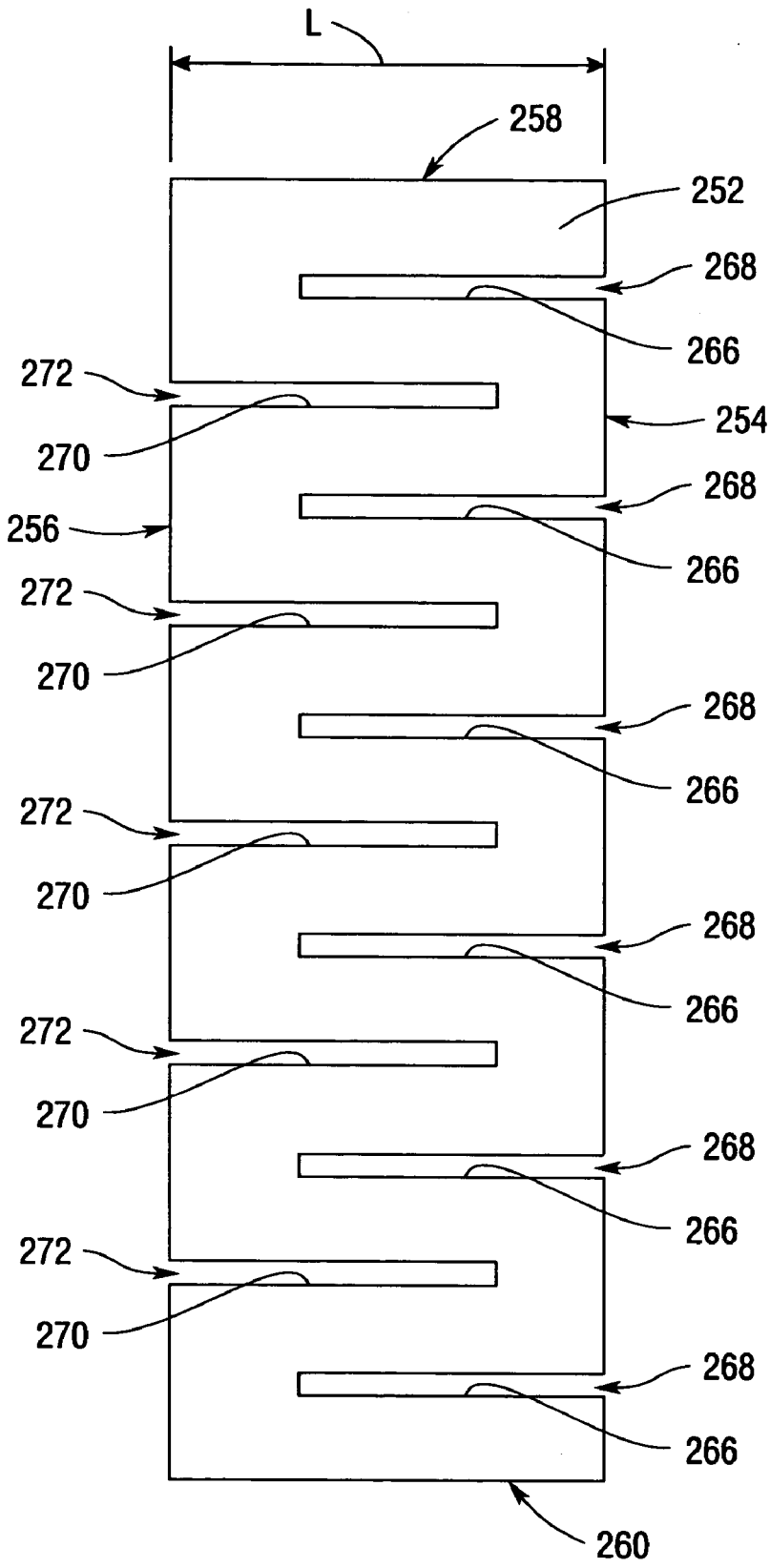
FIG. 9 is a view of substantially planar material employed to make one sleeve embodiment of the present invention.
Figure 10:
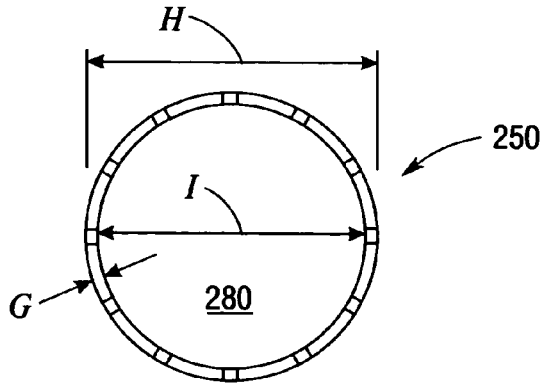
FIG. 10 is a top view of one sleeve embodiment of the present invention.

FIGS. 9–12 illustrate one embodiment of a retainer sleeve 250 of the present invention. The retainer sleeve 250 may be fabricated from, for example, metal, steel, plastic, etc. and have a thickness "G". In one embodiment, for example, the retainer sleeve 250 may be fabricated from a piece of substantially planar material 252 that has a thickness of approximately 0.075 inches. More specifically, as can be seen in FIG. 9, the substantially planar material 252 has a first elongated side 254, a second elongated side 256, a first end 258 and a second end 260. In this embodiment, the annular retainer sleeve 250 may be formed by wrapping the piece of material 252 around a mandrel or other object to provide the sleeve 250 with the desired outer diameter "H" and inner diameter "I" and bring the first and second ends 258 and 260 into spaced confronting relationship with each other. As will be explained in further detail below, diameters "H" and "I" are the diameters of the retainer sleeve 250 prior to its insertion into the sleeve-receiving hole 222 in the support block 220 and when a space "K" is provided between the first end 258 and the second end 260. See FIG. 11. Space "K" may be provided in some embodiments and essentially omitted in other embodiments. In particular, the gap ("K") between the first end 258 and the second end 260 of the retainer sleeve 250 may not be necessary in some embodiments. The ends 258, 260 may butt after the retainer sleeve 250 is on the shank. Furthermore, it will be appreciated that the end of the retainer sleeve may be compressed to enable it to be started into the sleeve-receiving bore. As will be further appreciated, in one embodiment, the inside surface of the retainer sleeve 250 is substantially smooth to enable the shank 208 to freely rotate therein when the retainer sleeve 250 has been installed in the support block 220.

Figure 11:
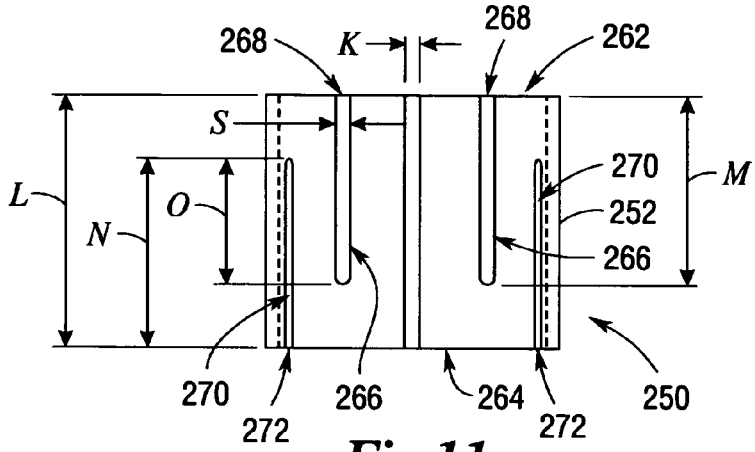
FIG. 11 is an elevational view of the sleeve of FIG. 10.
Figure 12:
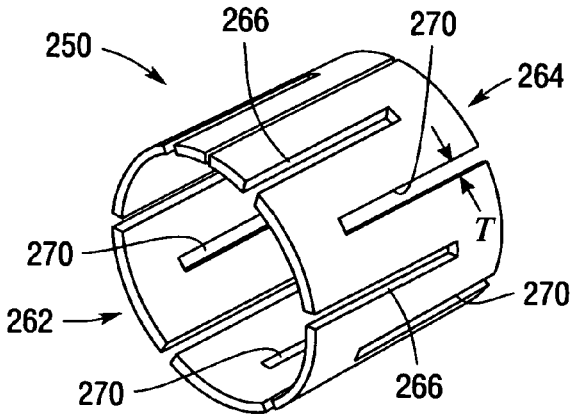
FIG. 12 is a perspective view of the sleeve of FIGS. 10 and 11.
Figure 13:
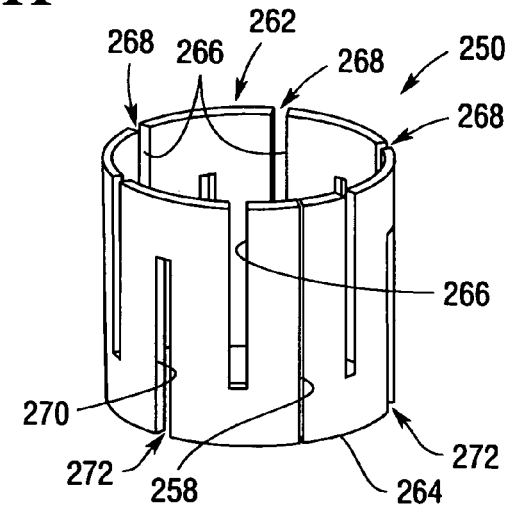
FIG. 13 is another perspective view of the sleeve of FIGS. 10–12.

Retainer sleeve 250 further has a length "L" that is less than the length "D" of the elongated shank 208 of the cutting bit 200 such that an amount of "end play" of approximately 0.06 inches is provided. In this embodiment, the retainer sleeve 250 is further provided with at least one first notch 266 that each form a corresponding first opening 268 in the leading end 262 and extend towards the trailing end 264 a first distance "M" that is less than the length "L" of the retainer sleeve 250. See FIG. 11. As used herein, the term "notch" means a cut extending into the sleeve a distance that is less than the length of the sleeve. Located between each first notch 266 is at least one opposing second notch 270. Each opposing second notch 270 forms a corresponding second opening 272 in the trailing end 264 of the sleeve 250 and extends toward the leading end 262 of the sleeve 250 a second distance "N" that is less than the length "L" of the sleeve. Thus, as can be seen in FIG. 11, the first notches 266 and the second notches 270 "overlap" a distance "O" in the center of the retainer sleeve 250.

The retainer sleeve 250 may be installed on the elongated shank 208 of the cutting bit 200 by separating the first and second ends 258, 260 to enable the shank 208 to be inserted into shank-receiving passage 280 within the sleeve 250. The elasticity of the material 252 will cause the first and second ends 258, 260 to regain their spaced-apart relationship (distance "K"—if provided) after the sleeve 250 has been installed on the shank 208. See FIG. 14. After the retainer sleeve 250 has been installed on the shank 208 of the cutting bit 200, the cutting bit assembly designated as 290, may be installed into the sleeve-receiving hole 222 in the support block 220 by inserting the retaining flange 210 into the sleeve-receiving hole 222.

In various embodiments of the present invention, the end of the retainer sleeve 250 acts as a series of seesaws as it is initially inserted into the sleeve-receiving hole 222 with relatively light pressure. Thereafter, the retainer sleeve 250 may be further pressed into or seated in the sleeve-receiving hole 222 upon the application of additional pressure through hammering or the like. Thus, the sleeve 250 may be started into the sleeve-receiving hole 222 a sufficient distance to retain it in position, without the need to support it as it is struck with a hammer or other insertion tool to thereby cause it to be seated within the sleeve-receiving hole 222 such that the contact face 205 is in contact with or close proximity to the leading end 226 of the support block 220. See FIGS. 7 and 15. Those of ordinary skill in the art will appreciate that when hardened cutting inserts 202 are employed, it is commonly desirable for the installer to avoid directly contacting the insert 202 with a rigid member that might cause damage to the insert. To avoid such damage, for example, the user may interpose a block of wood or other somewhat resilient or cushioning material onto the insert and then striking the block with a hammer or other suitable tool to seat the bit assembly 290 into the sleeve-receiving hole 222.

Figure 15:
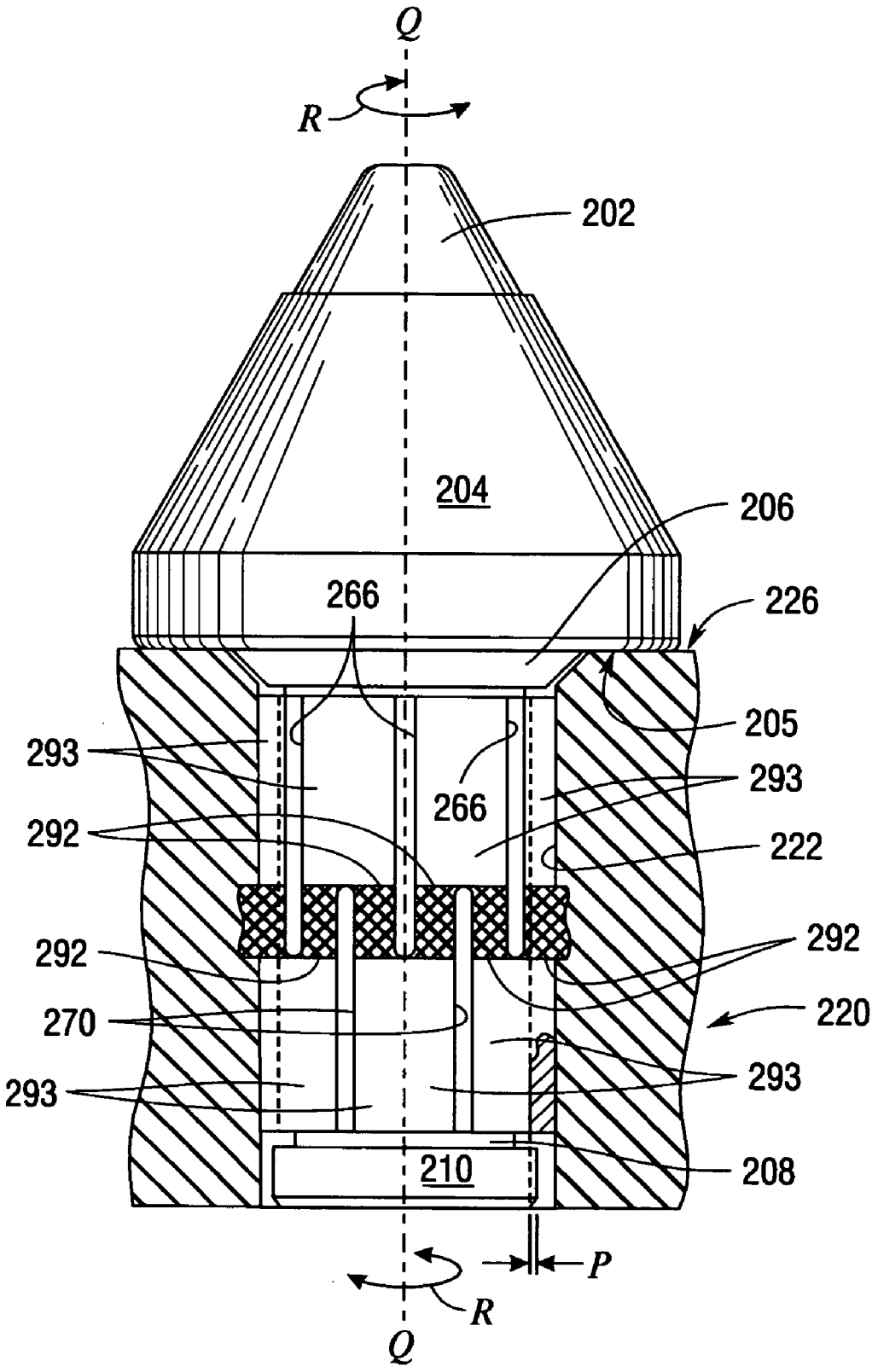
FIG. 15 is an enlarged view of the cutting bit assembly of FIG. 14 installed in a support block with portions of some elements shown in cross-section for clarity.

When installed as shown in FIG. 15, the retainer sleeve 250 imparts radial forces against the wall of the sleeve-receiving hole 222 to generate discrete "segments" of interference fit between the sleeve 250 and the wall of the sleeve-receiving hole 222. It will be understood that in the areas of overlap wherein the ends of the first notches 266 axially overlap the ends of the second notches 270, discrete segments of interference having the greatest magnitude (designated as 292) are generated. As used herein the phrase "discrete segments" means that the segments are apart from each other and that they are not completely annular. Thus, by altering the amount of axial overlap "O", these areas of increased interference fit may be increased or decreased. It will be understood, however, that lesser discrete segments of interference fit may be provided between the retainer sleeve 250 and the sleeve-receiving hole 222 in those areas between the respective first notches 266 and those areas between the respective second notches 270 wherein the first and second notches 266, 270 do not axially overlap, depending upon the outer diameter of the retainer sleeve 250 with respect to the inner diameter of the sleeve-receiving hole 222. Such areas of lesser interference fit are generally designed as 293 in FIG. 15 and are lesser in magnitude when compared to segments 292.

In this embodiment, when installed in this manner, the inner diameter "I" of the retainer sleeve 250 is larger than the diameter "A" of the elongated shank 208 such that the elongated shank 208 may freely rotate therein. However, as can be seen in FIG. 15, the shank 208 is retained in the sleeve and the sleeve-receiving hole 222 in the support block 220 by virtue of the overlap "P" of retaining flange 210 and the end of the sleeve 250. That is, the diameter "E" of the retaining flange 210 is greater than the final inner diameter "I'" of sleeve 250, yet smaller than the final outer diameter "H'" of retainer sleeve 250 to permit the flange 210 (and shank 208) to rotate about central axis Q—Q as indicated by arrows "R" in FIG. 15.

Such arrangement represents a vast improvement over prior methods for supporting and retaining cutting bits in support blocks. For example, when using prior sleeve arrangements that are pressed fit into a bore in a support block, the diameter and the total roundness of the bore are critical. If the diameter of the bore is too small, the sleeve could only be installed with great difficulty, if at all. In extreme instances, a bore that was too small may actually result in the sleeve becoming deformed or otherwise damaged which could result in damage to the bit shank. In many prior arrangements, the support block is heat treated and then machined to attain a bore with a very precise diameter. Such processes can be expensive and time consuming. Various wear sleeve embodiments of the present invention can alleviate the need for such very precise machining of the support block. For example, prior arrangements commonly employ press fits on the order of 0.001–0.002 inches on both diameter and T.I.R, whereas various sleeve embodiments of the present invention may conform to 0.005–0.010 inches on both diameter and T.I.R. or either of such dimensions. Furthermore, the unique and novel manner of employing the first and second notches in the sleeve enables higher retention forces to be generated. For example, for a retainer sleeve embodiment of the present invention manufactured from 1050 steel and having the dimensions listed below, retention forces on the order of 2700 pounds have been achieved:

EXAMPLE

Length of sleeve 250 (distance "L"): 1.000 inches;

Diameter "F" of sleeve-receiving hole 222 in support block 220: 1.510 inches and a circumference of 4.744 inches;

Diameter "A" of the elongated shank 208: 1.312 inches;

Diameter "E" of the retaining flange 210: 1.500 inches;

Outer diameter "H" of sleeve 250 (with ends butted): 1.540 inches;

Outer circumference (with ends butted): 4.838 inches;

Inner diameter "I" of sleeve 250 (with ends butted): 1.390 inches;

If provided—Space "K" between first and second ends 258, 260 (prior to insertion): 0.125 inches;

Number of first notches 266: three;

Length "M" of first notches 266: 0.550 inches;

Width "S" of first notches 266: 0.125 inches;

Number of second notches 270: three;

Length ""N"" of second notches 270: 0.550 inches;

Width "T" of second notches 270: 0.125 inches.

The foregoing dimensions are but one example of a retention sleeve embodiment of the present invention. By altering the number, length, width (circumferential length) and amount of axial overlap of the first and second notches, the number of interference segments can be altered thereby providing the user with easier installation while generating superior retention forces when compared to prior retention methods.

Figure 16:
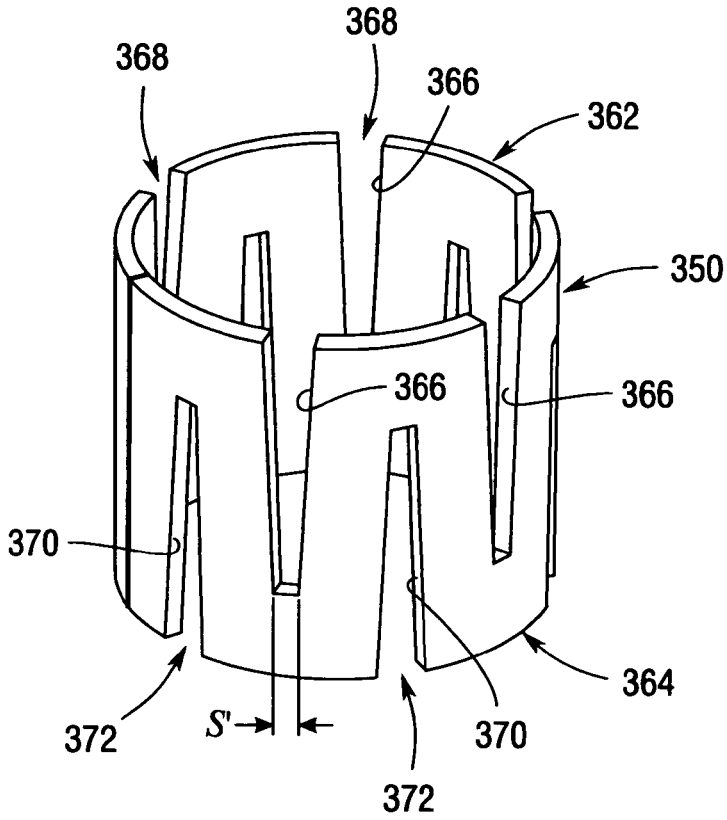
FIG. 16 is a perspective view of another sleeve embodiment of the present invention.
Figure 17:
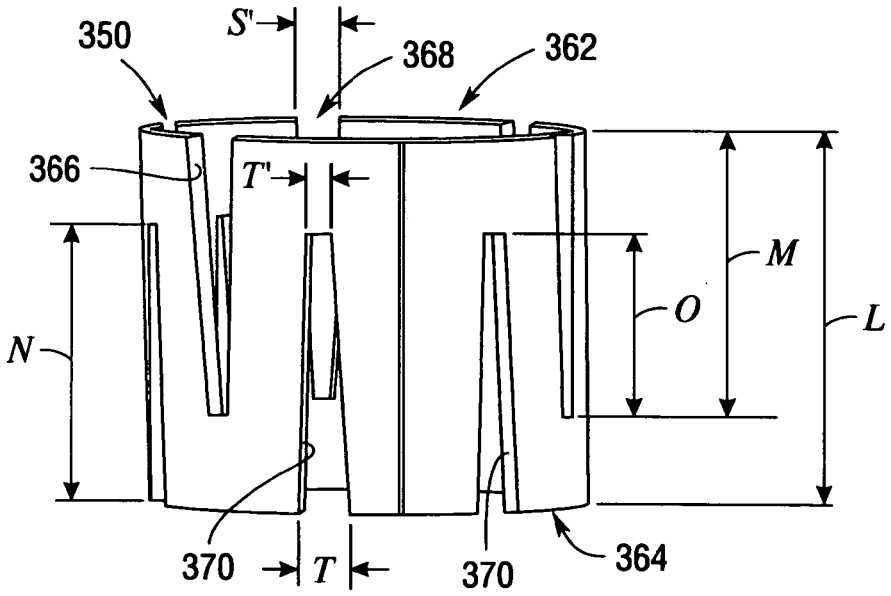
FIG. 17 is another perspective view of the sleeve of FIG. 16.

Another retainer sleeve embodiment of the present invention is depicted in FIGS. 16 and 17. In this embodiment, the retainer sleeve 350 is substantially identical in construction and use as retainer sleeve 250 described above. However, as can be seen in these Figures, at least one of the first notches 366 and at least one of the second notches 370 are tapered. More particularly, the tapered first notch 366 extends from a first notch opening 368 in the leading end 362 of the sleeve 350 towards the trailing end 364 a distance "M". The width "S" of the first notch 366 at the first notch opening is greater than the width "S'" at the bottom of the first notch 366. In one embodiment, for example, width "S" may be 0.250 inches and width "S'" may be 0.050 inches.

Likewise in this embodiment, at least one second notch 370 extends from a second notch opening 372 in the trailing end 364 of the sleeve 350 towards the leading end 362 a distance "N". The width "T" of the second notch 370 at the second notch opening is greater than the width "T'" located at the bottom of the second notch 370. In one embodiment, the width "T" may be 0.250 inches and the width "T'" may be 0.050 inches.

As can be seen in FIG. 17, the first and second notches 366 and 377 overlap a distance "O". In one embodiment, distance "M" may be 0.550 inches, distance "N" may be 0.550 inches, and distance "O" may be 0.050 inches for a sleeve 350 that has a length "L" of 1.000 inches. However, depending upon the particular application, it will be appreciated that the length of sleeve 350 and the lengths and widths of the first and second notches 366, 370, the amount of overlap "O" and the circumferential lengths of the segments of interference may be altered to achieve the desired degree of sleeve retention.

Figure 18:
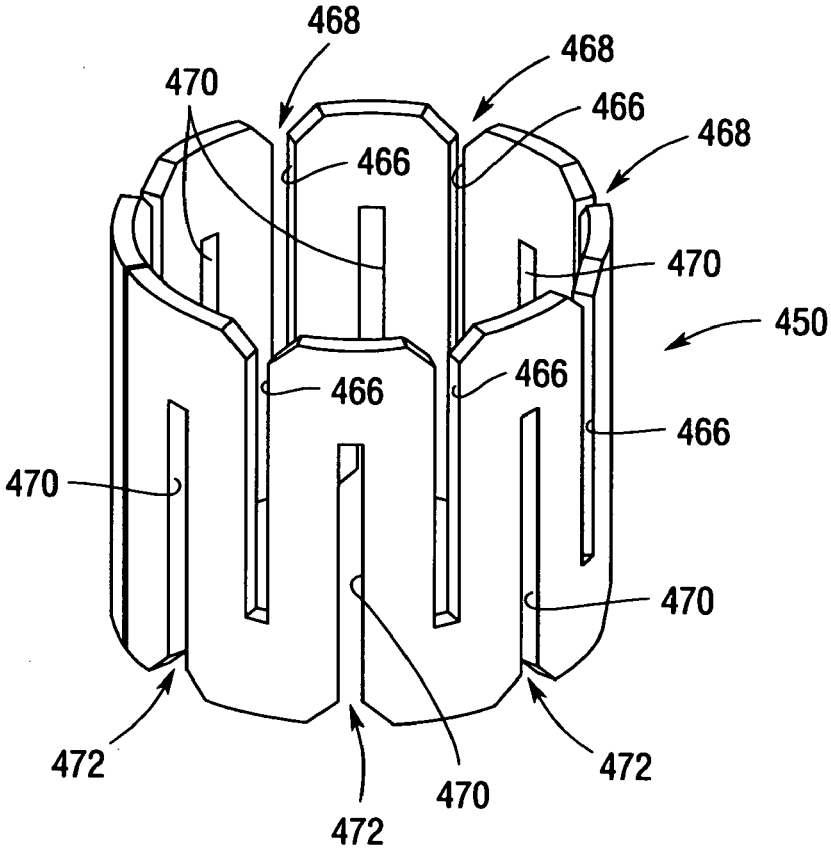
FIG. 18 is a perspective view of another sleeve embodiment of the present invention.
Figure 19:
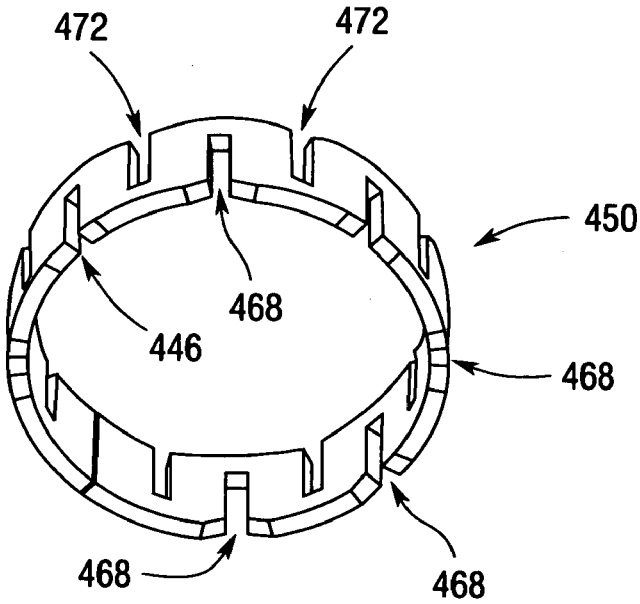
FIG. 19 is another end perspective view of the sleeve of FIG. 18.

FIGS. 18 and 19 illustrate another retainer sleeve embodiment of the present invention. The retainer sleeve 450 of this embodiment may be essentially identical in construction and use as retainer sleeve 250 described above. However, in this embodiment, the first openings 468 of the first notches 466 and the second openings 472 of the second notches 470 have chamfered sides. Such arrangement helps to prevent the retainer sleeves 450 from nesting during shipping and storage prior to installation. In addition, such arrangement can be somewhat easier to manufacture utilizing conventional stamping methods.

Figure 20:
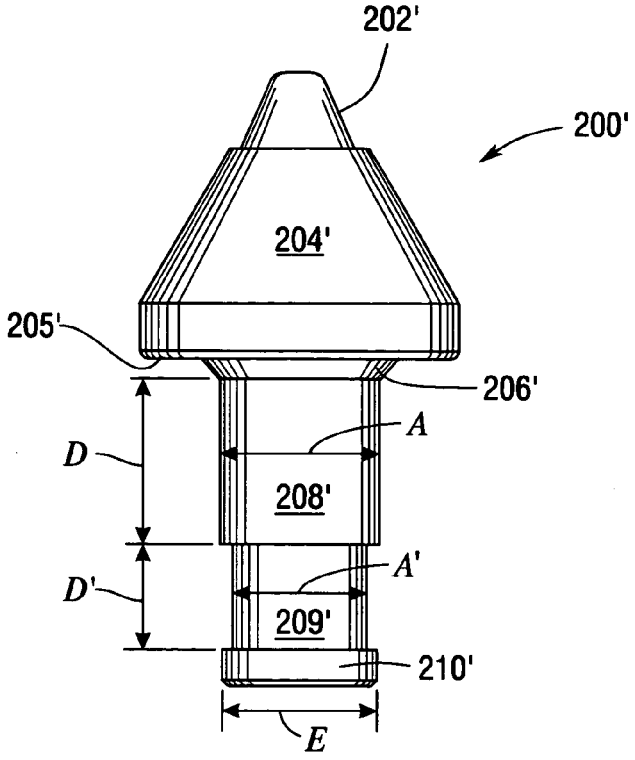
FIG. 20 is an elevational view of another cutting bit with which one or more sleeve embodiments of the present invention may be used.

FIG. 20 illustrates another cutting bit configuration 200' that is suited for use with a retainer sleeve 250' that does not extend substantially the entire length of the bit shank. More particularly and with reference to FIGS. 20 and 21, the cutting bit 200' has a cutting tip or insert 202' that is attached to a conical portion 204'. The cutting insert 202' may be fabricated from hardened material (carbide or the like) and be attached to the end of the conical portion 204' by brazing or other conventional fastening methods. The conical portion 204' terminates in a contact face 205' that has a frusto-conical portion 206' protruding therefrom. The cutting bit 200' further has an elongated shank portion 208' that has a diameter "A" and a reduced diameter portion 209' which has a diameter "A'" which is less than diameter "A". A retainer flange 210' is formed or otherwise provided on the end of the reduced diameter portion 209' that has a diameter that is substantially equal to the diameter "A" of shank portion 208' and which is less than the diameter "F" of a sleeve-receiving hole 222 in a support block 220. The axial length "D'" of the reduced diameter portion 209' may be less than the axial length "D" of the shank portion 208'. For example, in one embodiment, axial length "D'" may be less than or equal to the length "D". See FIG. 20.

Figure 21:
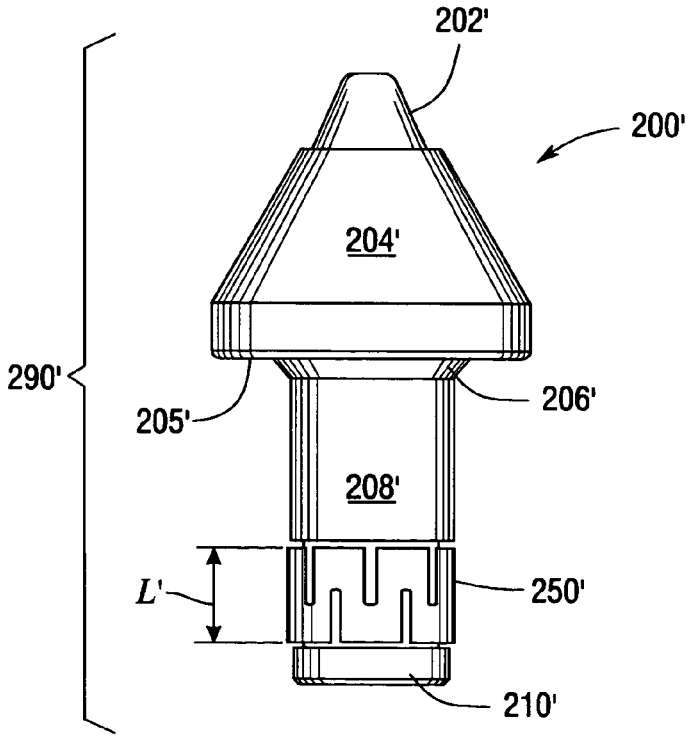
FIG. 21 is an elevational view of the cutting bit of FIG. 20 with a sleeve embodiment of the present invention installed thereon.

In this embodiment, retainer sleeve 250' may be substantially identical in construction as retainer sleeve 250 except that the length "L'" of retainer sleeve 250' is slightly less than the length "D'" of the reduced diameter portion 509' to permit the retainer sleeve 250' to be installed on the necked-down portion 209' as shown in FIG. 21 to form a bit assembly 290'. Bit assembly 290' is installed in the same manner as was discussed above with respect to bit assembly 290. It will be appreciated, however, that the end of the retainer sleeve 250' acts as a series of radial seesaws as it is initially inserted into the sleeve-receiving hole 222 with relatively light pressure. Thereafter, the retainer sleeve 250' is further pressed into or seated in the sleeve-receiving hole 222 upon the application of additional pressure through hammering or the like. Thus, the installer does not have to hold the bit assembly 290' during installation into the sleeve receiving hole 222. The retainer sleeve 250' serves to retain the bit 200' in the support block 220 in the manner discussed above with respect to sleeve 250 while permitting it to rotate about its axis within the sleeve 250' and the sleeve-receiving hole 222.

Figure 22:
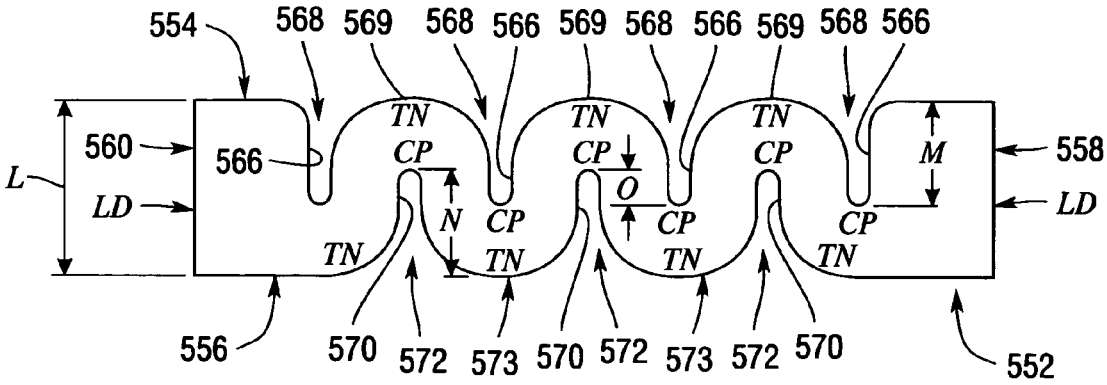
FIG. 22 is a view of another substantially planar material employed to make another sleeve embodiment of the present invention.
Figure 23:
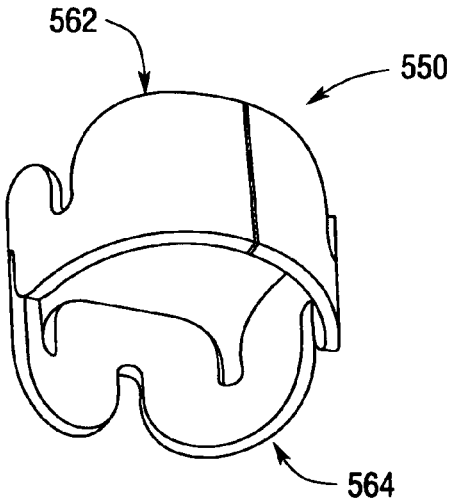
FIG. 23 is an end perspective view of another sleeve embodiment of the present invention.
Figure 24:
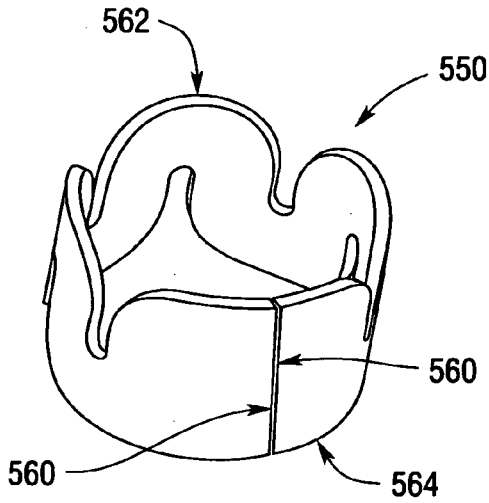
FIG. 24 is another perspective view of the sleeve embodiment of FIG. 23.

FIGS. 22–24 illustrate another retainer sleeve embodiment of the present invention. In this embodiment, for example, the retainer sleeve 550 may be fabricated from a piece of substantially planar material 552 (i.e., plastic, metal, etc.) that has a thickness of approximately 0.075 inches. More specifically, as can be seen in FIG. 22, the substantially planar material 552 has a first elongated side 554, a second elongated side 556, a first end 558 and a second end 560. The annular retainer sleeve 550 may be formed by wrapping the piece of material 552 around a mandrel or other object to provide the sleeve 550 with the desired outer diameter and bring the first and second ends 558 and 560 into spaced confronting relationship with each other in a similar manner as was discussed above with respect to sleeve 250. In other embodiments, however, the first and second ends 558 and 560 may be arranged in abutting relationship with no space or gap therebetween.

When configured as an annular ring, the retainer sleeve 550 has a leading end 562 and a trailing end 564. Retainer sleeve 550 may be configured to be used in connection with a full length shank 208 of a cutting bit 200 or be used in connection with a cutting bit 200' as illustrated in FIG. 20. In this embodiment, the sleeve 550 is further provided with at least one first notch 566 that each form a corresponding first opening 568 in the leading end 562 and extend towards the trailing end 564 a first distance "M" that is less than the length "L" of the sleeve 550. As can be seen in FIG. 22, however, unlike retainer sleeve 250, retainer sleeve 550 has first arcuate portions 569 that extend between the first openings 568. Located between each first notch 566 is at least one opposed second notch 570. Each second notch 570 forms a corresponding second opening 572 in the trailing end 564 of the sleeve 550 and extends toward the leading end 562 of the sleeve 550 a second distance "N" that is less than the length "L" of the sleeve 550. Thus, as can be seen in FIG. 20, the first notches 566 and the second notches 570 "overlap" a distance "O" in the center of the retainer sleeve 550. The retainer sleeve 550 further has second arcuate sections 573 that extend between the second openings 572. The first and second arcuate portions 569, 573 serve to assist in preventing the retainer sleeves from nesting during shipping or storage and further simplify stamping operations wherein the sleeve material is stamped to its desired shape utilizing conventional stamping methods.

Figure 25:
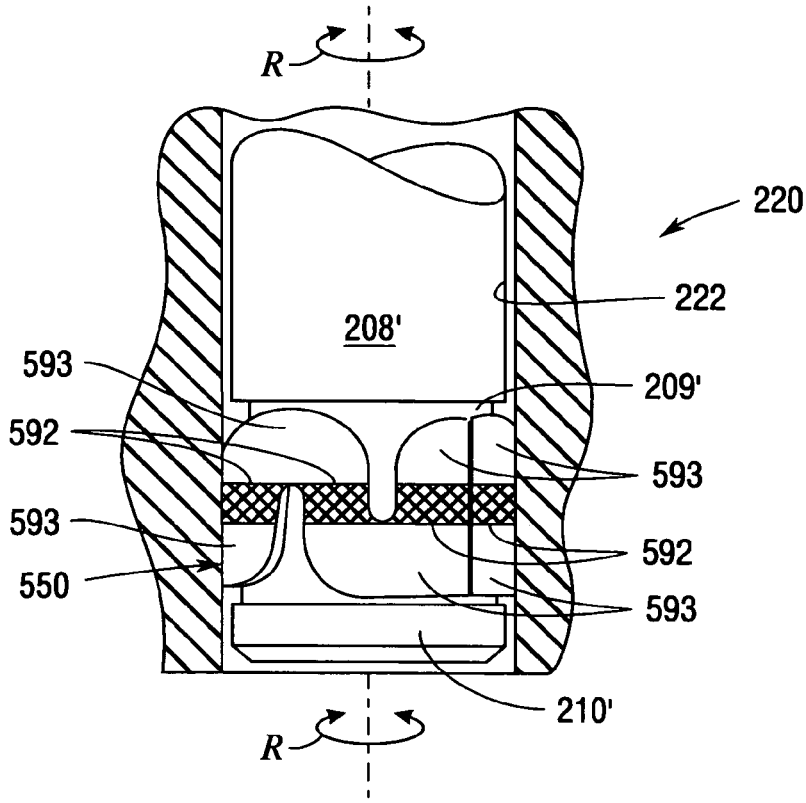
FIG. 25 is a partial cross-sectional view of a sleeve and cutting bit assembly embodiment of the present invention installed in a support block.

The retainer sleeve 550 may be installed on a cutting bit 200 or 200' in the manners discussed above with respect to retainer sleeves 250, 250', respectively. When installed in the sleeve-receiving hole 222 and the first end 558 and the second end 560 abut each other, various loads and stresses are applied to the sleeve 550. For example, FIG. 22 illustrates those portions of the retainer sleeve 550 that are under compression ("CP") those portions that are under tension ("TN") and the directions in which the load "(LD") is applied. The retainer sleeve 550 acts as a circumferential spring, pressing radially against the wall of the sleeve-receiving hole 222 in the support block 220. The segments wherein the greatest amount of radial retention force is generated is defined by the areas in which the first notches 566 and the second notches 570 overlap (designated as 592). It will be understood, however, that lesser discrete segments of interference fit may be provided between the sleeve 550 and the sleeve-receiving hole 222 in those areas between the respective first notches 566 and those areas between the respective second notches 570 wherein the first and second notches 566, 570 do not overlap, depending upon the outer diameter of the retainer sleeve 550 with respect to the inner diameter of the sleeve-receiving hole 222. Such areas of lesser interference fit are generally designed as 593 in FIG. 25 and are lesser in magnitude when compared to segments 592.

When the retainer sleeve 550 is inserted into the sleeve-receiving hole 222 and the first and second ends 558, 560 are in abutment with each other, the retainer sleeve 550 retains the retainer flange 510 while facilitating rotation of the reduced diameter portion 509' (or the entire shank 208) about its axis "Q'—Q'" within the sleeve 550. The rotation is represented by arrows "R" in FIG. 25.

Figure 26:
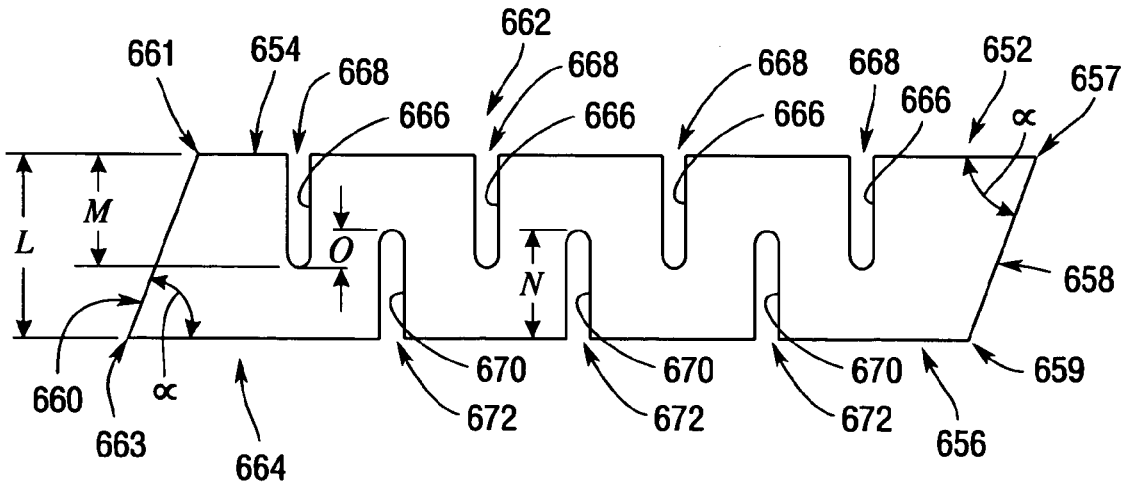
FIG. 26 is a view of another substantially planar material employed to make another sleeve embodiment of the present invention.
Figure 27:
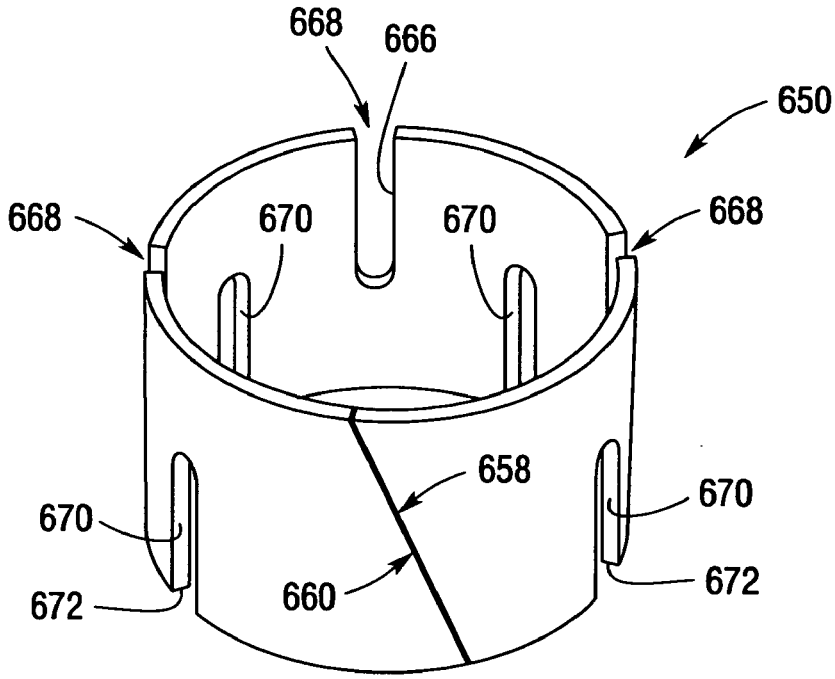
FIG. 27 is a perspective view of a sleeve embodiment of the present invention fabricated from the substantially planar material of FIG. 26.
Figure 28:
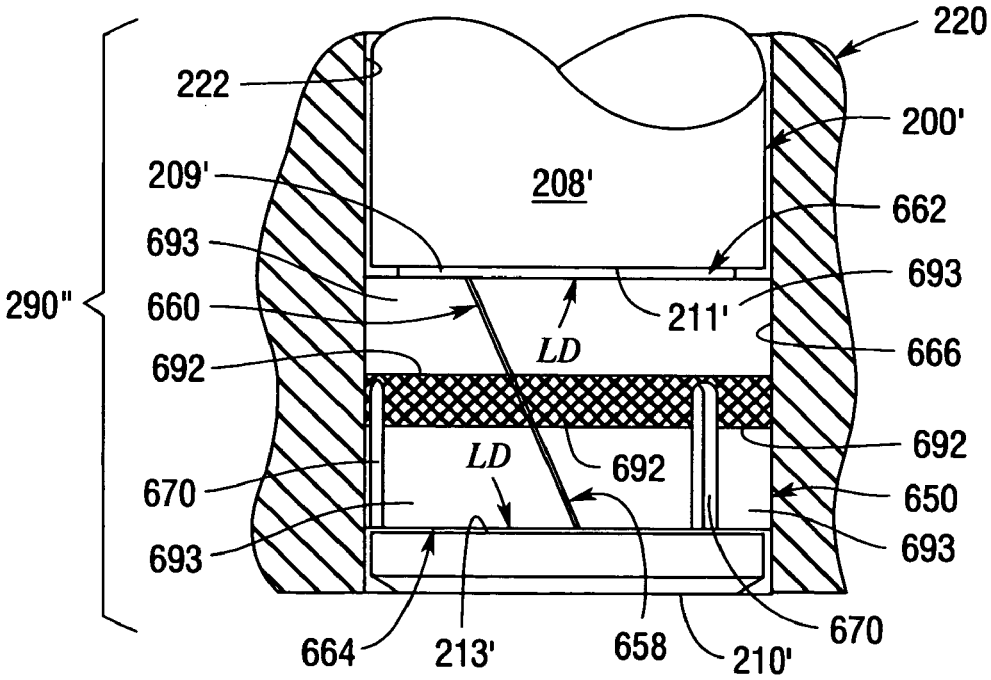
FIG. 28 is a partial cross-sectional view of the sleeve of FIG. 27 installed in a support block and support a cutting bit of the type depicted in FIG. 20 therein.

FIGS. 26–28 illustrate another retainer sleeve embodiment of the present invention which may be used in connection with a cutting bit 200' (or other bits and sleeves having similar shaped shanks) for applications wherein it is desirable to prevent the shank portions 208' and 209' from rotating within the sleeve-receiving hole 222 in the support member 220. As can be seen in FIG. 26, the material 652 from which the retainer sleeve 650 may be fabricated may consist of substantially planar metal, plastic, etc. material and be fabricated in the same manner as material 252 described above. Material 652 has a first elongated side 654, a second elongated side 656, a first end 658 and a second end 660. As can be seen in FIG. 26, the material 652 is further provided with at least one first notch 666 that each form a corresponding first opening 668 in the leading end 662 and extend towards the trailing end 664 a first distance "M" that is less than the length "L" of the sleeve 650. Located between each first notch 666 is at least one opposing second notch 670. Each second notch 670 forms a corresponding second opening 672 in the trailing end 664 of the sleeve 650 and extends toward the leading end 662 of the sleeve 650 a second distance "N" that is less than the length "L" of the sleeve. Thus, as can be seen in FIG. 26, the first notches 666 and the second notches 670 axially "overlap" a distance "O" in the center of the retainer sleeve 650.

The main difference between retainer sleeves 250 described above and retainer sleeve 650 and is that the first and second ends 658 and 660 of the retainer sleeve 650 are angled. In particular, the first end 658 extends from a first point 657 on the first elongated side to a second point 659 on the second elongated side 656 such that there is an acute angle "α" between the leading end formed by the first elongated edge 652 and the first end 658. Likewise, the second end 660 extends from another point 661 on the first elongated side 654 to another second point 663 on the second elongated side 656 such that a is formed between the trailing end formed by the second elongated side and the second end 660. See FIG. 26. In one embodiment, angle α may be approximately 70°; however, angle α could conceivably range from 85 to 10.

As can be seen in FIG. 28, the reduced diameter portion 209' of the bit 200' forms an upper annular ledge 211' and a lower annular ledge 213'. When the retainer sleeve 650 is installed on the reduced diameter portion 209' of the bit 200' to form the cutting bit assembly 290" and the cutting bit assembly is inserted into the sleeve-receiving hole 222 in the support block 220, the sleeve engages the wall of the hole 222 and serves to retain the bit 200' in the hole 222. The first end 658 and the second end 660 are in abutting contact and serve to apply opposing forces in the directions of arrows "LD" in FIG. 28 against the retention ledges 211' and 213' which serve to prevent the rotation of the bit 200' within the retainer sleeve 600 and thus, within the sleeve-receiving hole 222. See FIG. 28. As with the above-described embodiments, the greatest areas of interference fit and retention forces are generated in the discrete segments wherein the first and second notches axially overlap (designated as segments 692 in FIG. 28). It will be understood, however, that lesser discrete segments of interference fit may be provided between the sleeve 650 and the sleeve-receiving hole 222 in those areas between the respective first notches 666 and those areas between the respective second notches 670 wherein the first and second notches 666, 670 do not axially overlap, depending upon the outer diameter of the sleeve 650 with respect to the inner diameter of the sleeve-receiving hole 222. Such areas of lesser interference fit are generally designed as 693 in FIG. 28 and are lesser in magnitude when compared to segments 692.

Figure 29:
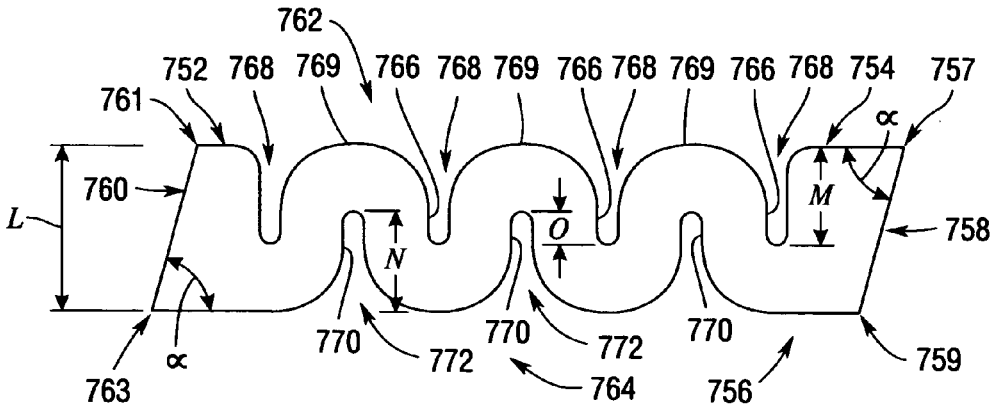
FIG. 29 is a view of another substantially planar material employed to make another sleeve embodiment of the present invention.
Figure 30:
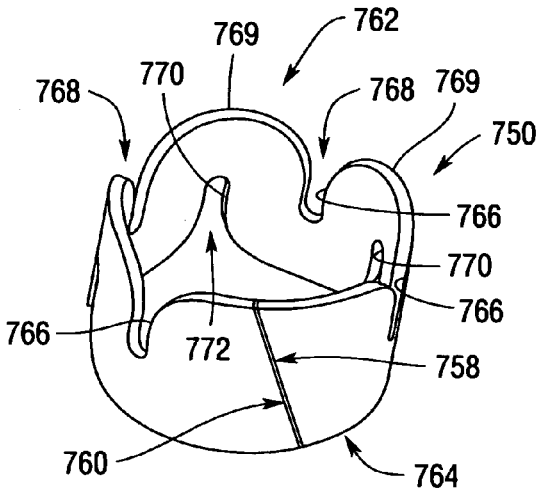
FIG. 30 is an end perspective view of another sleeve embodiment of the present invention.
Figure 31:
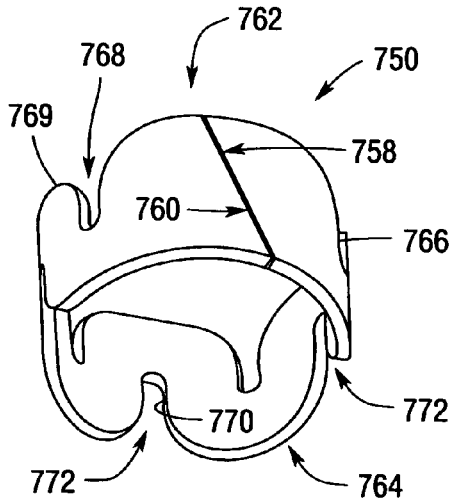
FIG. 31 is another perspective view of the sleeve embodiment of FIG. 30.

FIGS. 29–31 illustrates another retainer sleeve embodiment of the present invention for use with a cutting bit 200' of the type and construction described above. Retainer sleeve 750 may essentially be identical in construction to retainer sleeve 550, except that the first and second ends 758 and 760 are provided at acute angles in the manners described above. More particularly and with reference to FIG. 29, the material 752 from which the retainer sleeve 750 may be fabricated may consist of substantially planar metal, plastic, etc. material and be fabricated in the same manner as material 252 described above. Material 752 has a first elongated side 754, a second elongated side 756, a first end 758 and a second end 760. As can be seen in FIG. 29, the material 752 is further provided with at least one first notch 766 that each form a corresponding first opening 768 in the leading end 762 and extend towards the trailing end 764 a first distance "M" that is less than the length "L" of the retainer sleeve 750. In this embodiment, first arcuate portions 769 extend between each first opening 768. Located between each first notch 766 is at least one opposed second notch 770. Each second notch 770 forms a corresponding second opening 772 in the trailing end 664 of the retainer sleeve 750 and extends toward the leading end 762 of the retainer sleeve 750 a second distance "N" that is less than the length "L" of the retainer sleeve 750. Thus, as can be seen in FIG. 29, the first notches 766 and the second notches 770 axially "overlap" a distance "O" in the center of the retainer sleeve 750.

One difference between retainer sleeves 250 described above and retainer sleeve 750 is that the first and second ends 758 and 760 are angled. In particular, the first end 758 extends from a first point 757 on the first elongated side 754 to a second point 759 on the second elongated side 756 such that there is an acute angle "α" between the leading end formed by the first elongated edge 752 and the first end 758. Likewise, the second end 760 extends from another point 761 on the first elongated side 754 to another second point 763 on the second elongated side 756 such that a is formed between the trailing end formed by the second elongated side and the second end 760. See FIG. 29. In one embodiment, angle α may be approximately 70°; however, angle α could conceivably range from 85 to 10.

Figure 32:
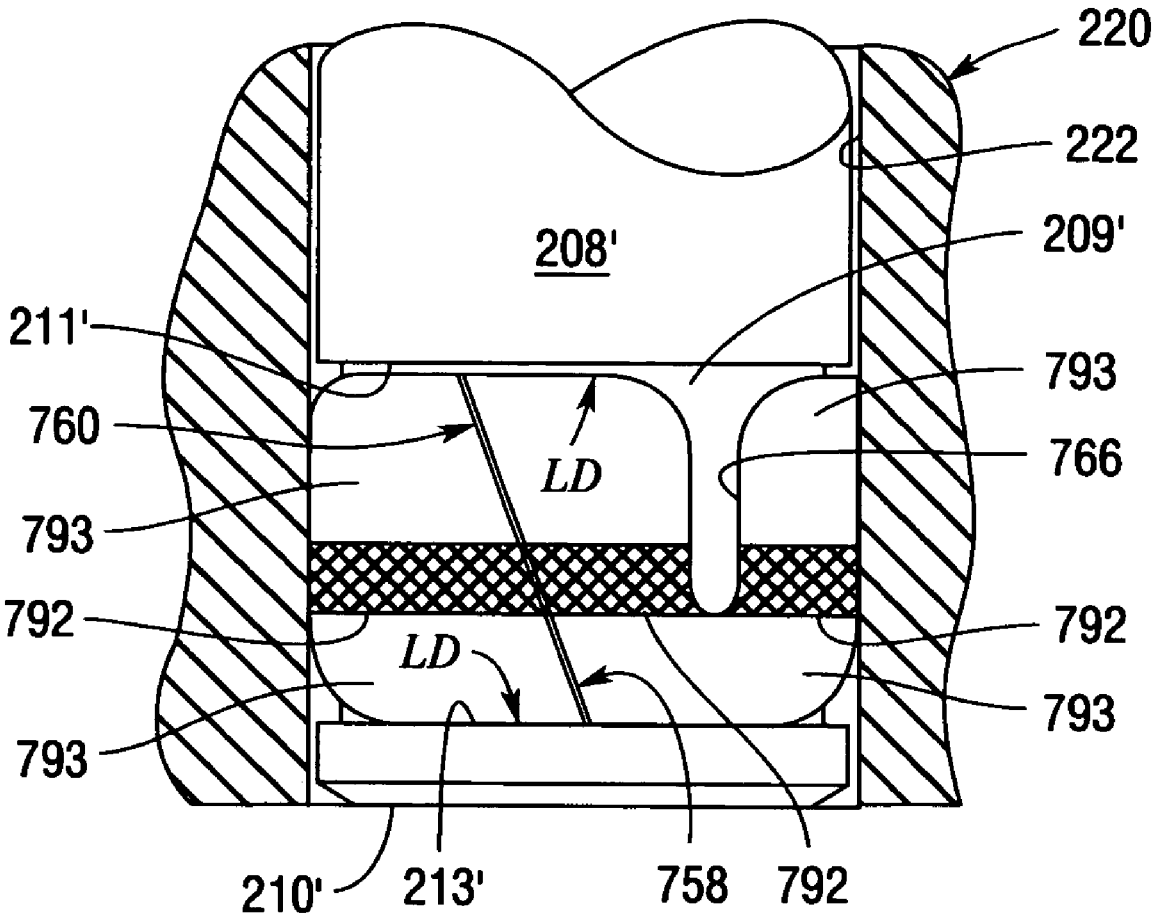
FIG. 32 is a partial cross-sectional view of the sleeve of FIGS. 30 and 31 installed in a support block and supporting a cutting bit of the type depicted in FIG. 20 therein.
Figure 33:
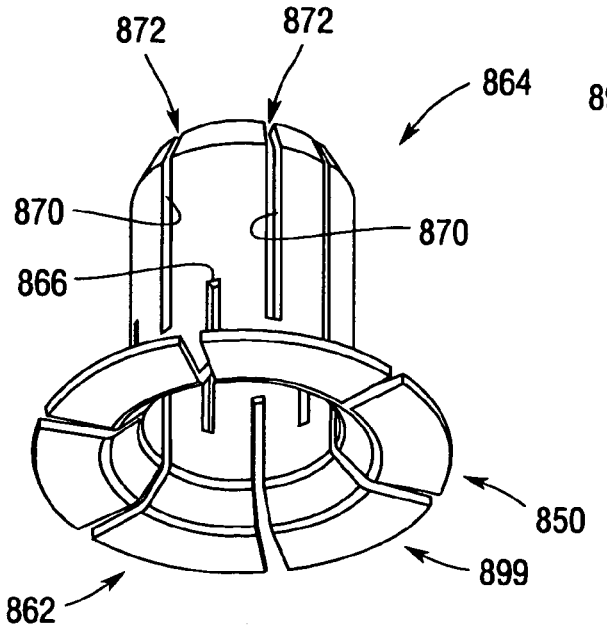
FIG. 33 is a perspective view of a wear sleeve embodiment of the present invention.
Figure 34:
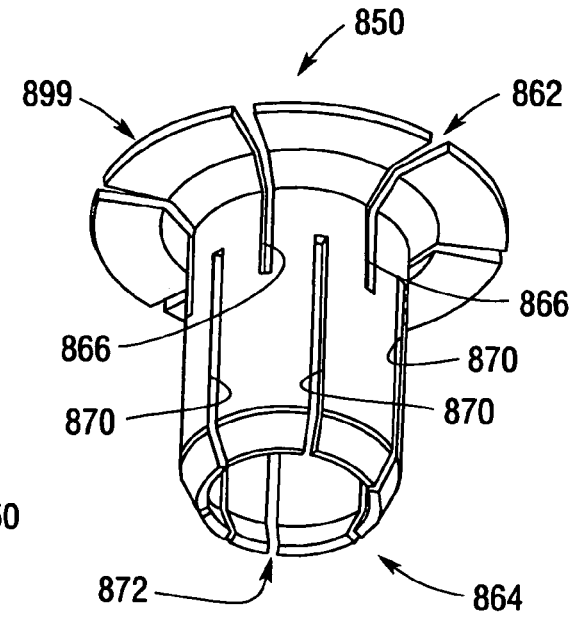
FIG. 34 is another perspective view of the sleeve of FIG. 33.
Figure 35:
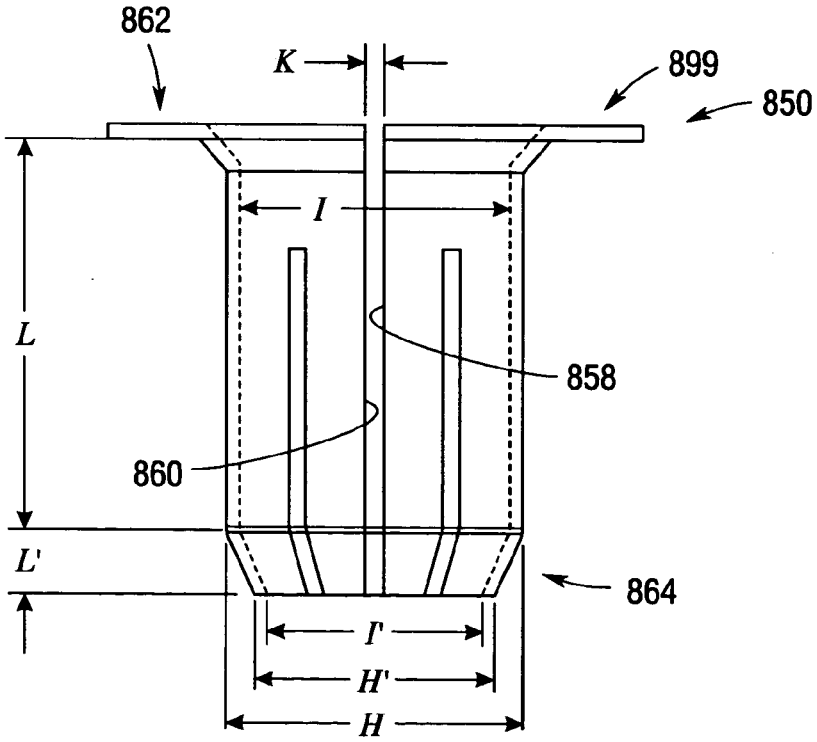
FIG. 35 is an elevational view of the sleeve of FIGS. 33 and 34.

When the retainer sleeve 750 is installed on the reduced diameter portion 209' of the bit 200' to form the cutting bit assembly 290" and the cutting bit assembly 290" is inserted into the sleeve-receiving hole 222 in the support block 220, the retainer sleeve 750 engages the wall of the hole 222 and serves to retain the bit 200' in the hole 222. The first end 758 and the second end 760 are in abutting contact and serve to apply opposing forces in the directions of arrows "LD" to engage the retention ledges 211" and 213" which serves to prevent the rotation of the bit 200' within the retainer sleeve 750 and thus, within the sleeve-receiving hole 222. See FIG. 32. As with various of the above-described embodiments, the greatest magnitude of interference and retention forces are generated in the discrete segments wherein the first and second notches overlap (designed as segments 792 in FIG. 32). It will be understood, however, that lesser discrete segments of interference fit may be provided between the retainer sleeve 750 and the sleeve-receiving hole 222 in those areas between the respective first notches 766 and those areas between the respective second notches 770 wherein the first and second notches 766, 770 do not axially overlap, depending upon the outer diameter of the retainer sleeve 750 with respect to the inner diameter of the sleeve-receiving hole 222. Such areas of lesser interference fit are generally designed as 793 in FIG. 32 and are lesser in magnitude when compared to segments 792.

FIGS. 33–36 illustrate another retainer sleeve embodiment of the present invention. The sleeve 850 may be fabricated by stamping them from material such as metal, steel, plastic etc. like and then forming them utilizing conventional forming methods. The retainer sleeve 850 may be configured with a first outer diameter "H", a second outer diameter "H'" and inner diameter "I". As will be explained in further detail below, diameters "H" and "I" are the diameters of the sleeve 850 prior to its insertion into the sleeve-receiving hole 222 in the support block 220 and wherein a space "K" is provided between the first end 858 and the second end 860 of the sleeve 850. When inserted into sleeve-receiving hole 222 in a support block 220, the first and second ends 858 and 860 will abut each other. Also in this embodiment, the retainer sleeve 850 is provided with a segmented wear flange 899 on its leading end 862 for supporting a flanged portion of a cutting bit 200' thereon. Retainer sleeve 850 also has a trailing end 864 wherein the outer diameter "H'" is less than diameter "H" and the inner diameter "I'" is less than "I". Retainer further has a length "L" that is less than the length "D" of the shank portion 208' and a length "L'" that is slightly less than the length "D'" of the necked-down portion 209' of the cutting bit 200'. See FIGS. 20 and 36.

Figure 36:
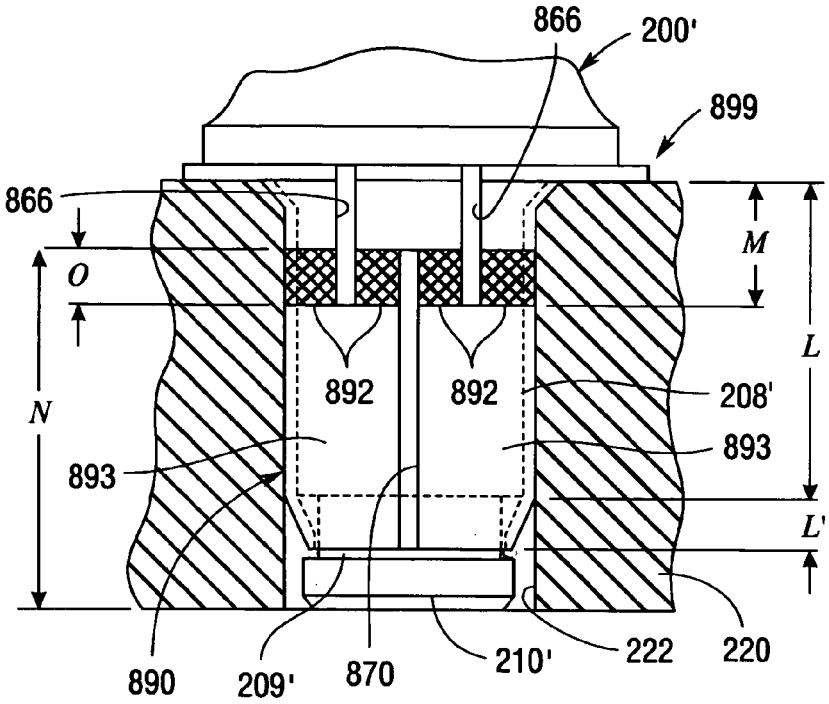
FIG. 36 is a partial cross-sectional view of the sleeve of FIGS. 33–35 installed in a support block and supporting a cutting bit therein.

In this embodiment, the retainer sleeve 850 is further provided with at least one first notch 866 that each extend through the flange 890 and extend towards the trailing end 864 a first distance "M" that is less than the length "L". Located between each first notch 866 is at least one opposed second notch 870. Each second notch 870 forms a corresponding second opening 872 in the trailing end 864 of the sleeve 850 and extends toward the leading end 862 of the sleeve 850 a second distance "N" that is less than the length "L" of the sleeve. Thus, as can be seen in FIG. 36, the first notches 866 and the second notches 870 axially "overlap" a distance "O" in upper portion of the retainer sleeve 850.

The retainer sleeve 850 may be installed on the shank portions 208' and 209' of the cutting bit 200' by separating the first and second ends 858, 860 to enable the shank portions 208' and 209' to be inserted into shank-receiving passage 880 within the retainer sleeve 850. The elasticity of the retainer sleeve 850 will cause the first and second ends 858, 860 to regain their spaced-apart relationship (distance "K"—if provided) after the retainer sleeve 850 has been installed on the shank portions 208' and 209'. After the retainer sleeve 850 has been installed on the shank portions 208' and 209' of the cutting bit 200', the cutting bit assembly designated as 890, may be first inserted into the sleeve-receiving hole 222 in the support block 220 and then the cutting bit 200' may be inserted into the sleeve-receiving passage 880 therein. The shank portion 208' of the bit 200' causes the first and second ends 858, 860 of the retainer sleeve 850 to abut each other and establish radially acting forces therein which urge against the wall of the sleeve-receiving hole 222. Those areas wherein the first and second notches 866, 870 axially overlap establish discrete segments of interference fit (designated as 892) between the retainer sleeve 850 and the wall of the sleeve-receiving hole 222 wherein the retention forces are the greatest. It will be understood, however, that lesser discrete segments of interference fit may be provided between the sleeve 850 and the sleeve-receiving hole 222 in those areas between the respective first notches 866 and those areas between the respective second notches 870 wherein the first and second notches 866, 870 do not axially overlap, depending upon the outer diameter of the retainer sleeve 850 with respect to the inner diameter of the sleeve-receiving hole 222. Such areas of lesser interference fit are generally designed as 893 in FIG. 36 and are lesser in magnitude when compared to segments 892.

The cutting bit 200' is rotatably retained within the retainer sleeve 850 because the diameter "E" of the retention flange 210' is greater than the diameter H' on the trailing end of the sleeve 850. The flange 899 of the retainer sleeve 850 serves to protect the forward face of the support block from damage caused by the flanged portion of the cutting bit 200'.

Figure 37:
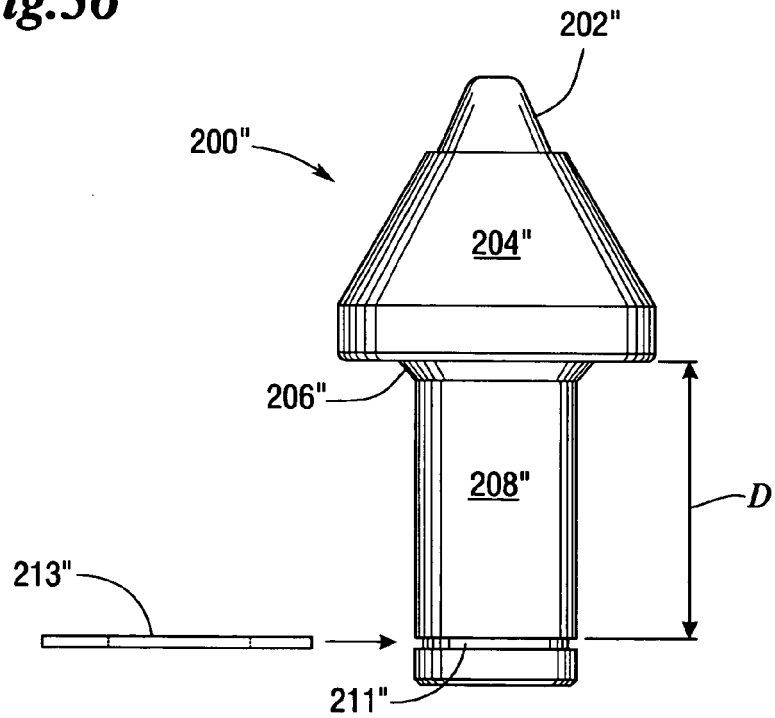
FIG. 37 is an elevational view of another cutting bit with which one or more sleeve embodiments of the present invention may be employed.
Figure 38:
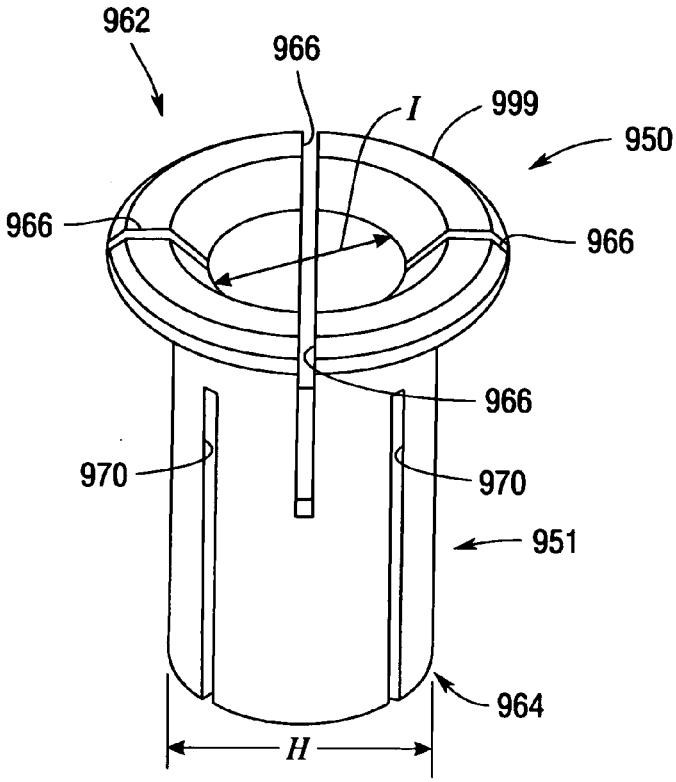
FIG. 38 is a perspective view of a wear sleeve embodiment of the present invention.
Figure 39:
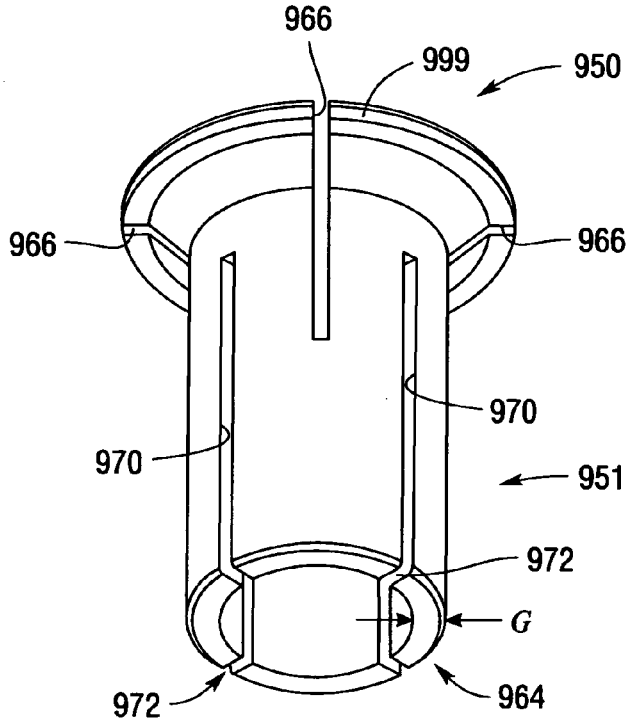
FIG. 39 is another perspective view of the sleeve of FIG. 38.
Figure 40:
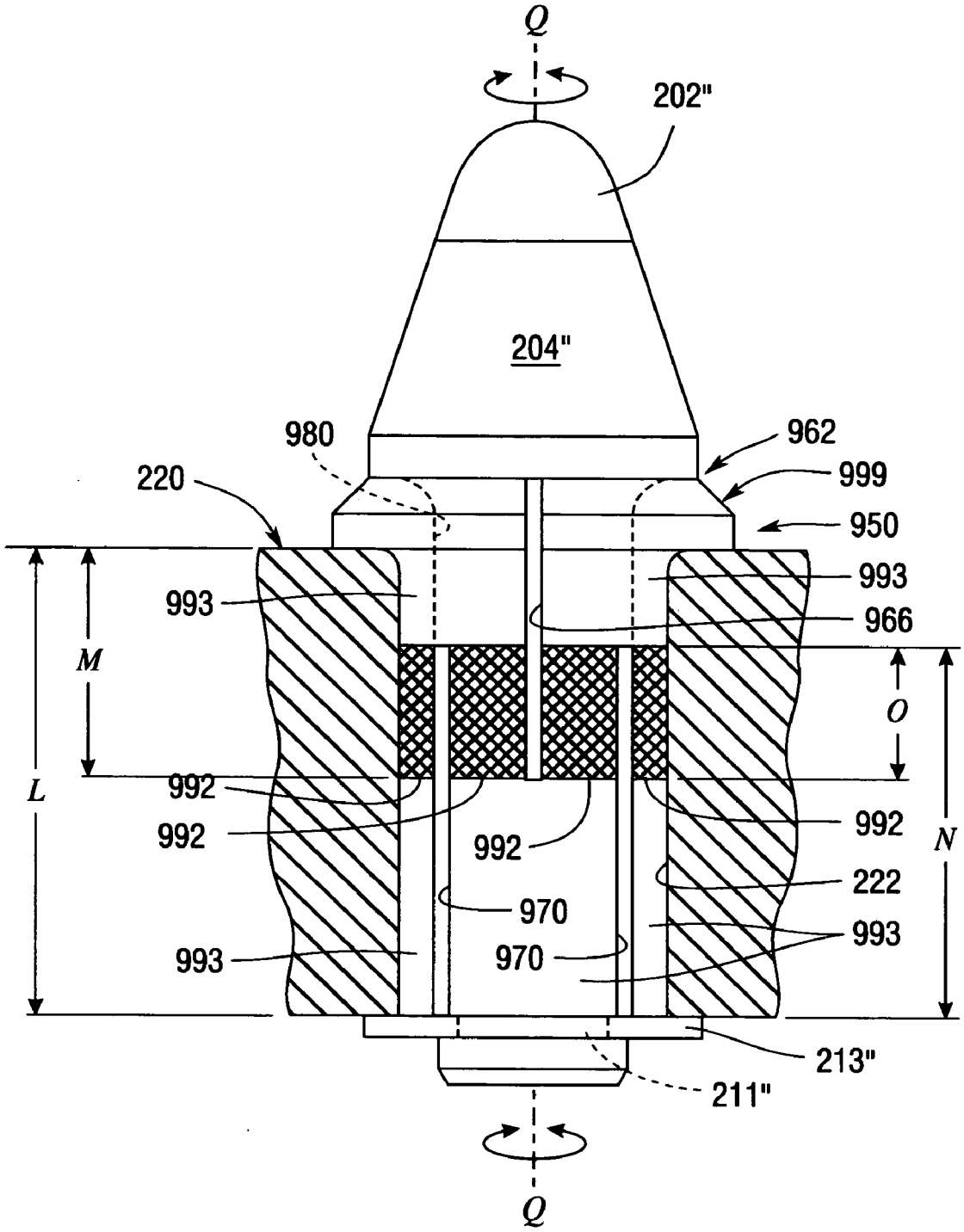
FIG. 40 is a partial cross-sectional view of the sleeve of FIGS. 38 and 39 installed in a support block and supporting a cutting bit therein.
Figure 42:
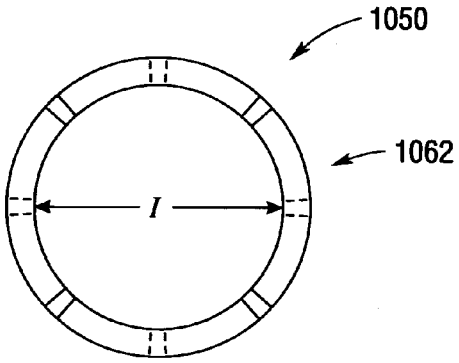
FIG. 42 is a top view of the sleeve of FIG. 41.
Figure 43:
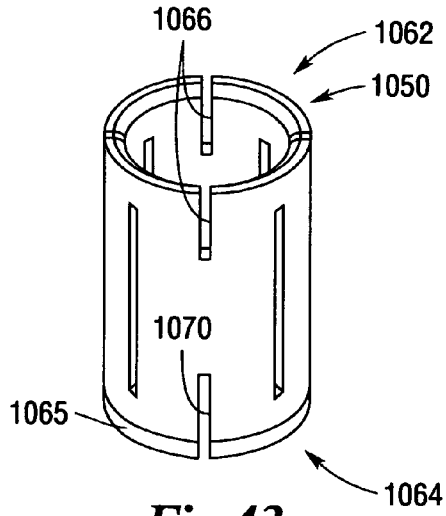
FIG. 43 is a perspective view of the sleeve of FIGS. 41 and 42.
Figure 41:
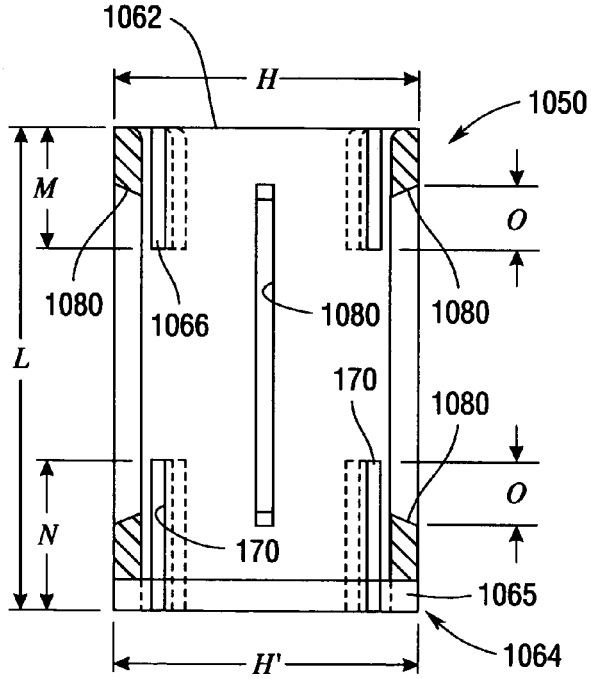
FIG. 41 is a cross-sectional elevational view of another sleeve embodiment of the present invention.
Figure 44:
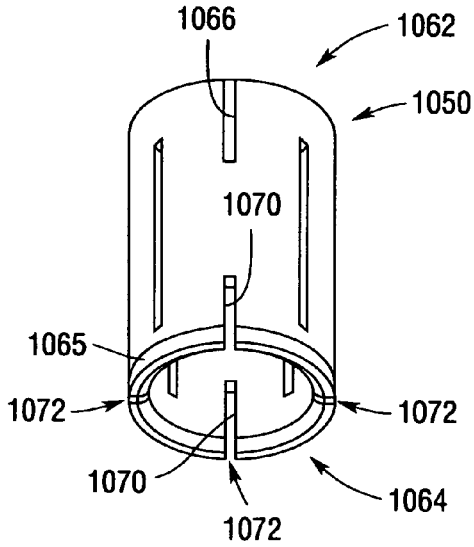
FIG. 44 is another perspective view of the sleeves depicted in FIGS. 41–43.
Figure 45:
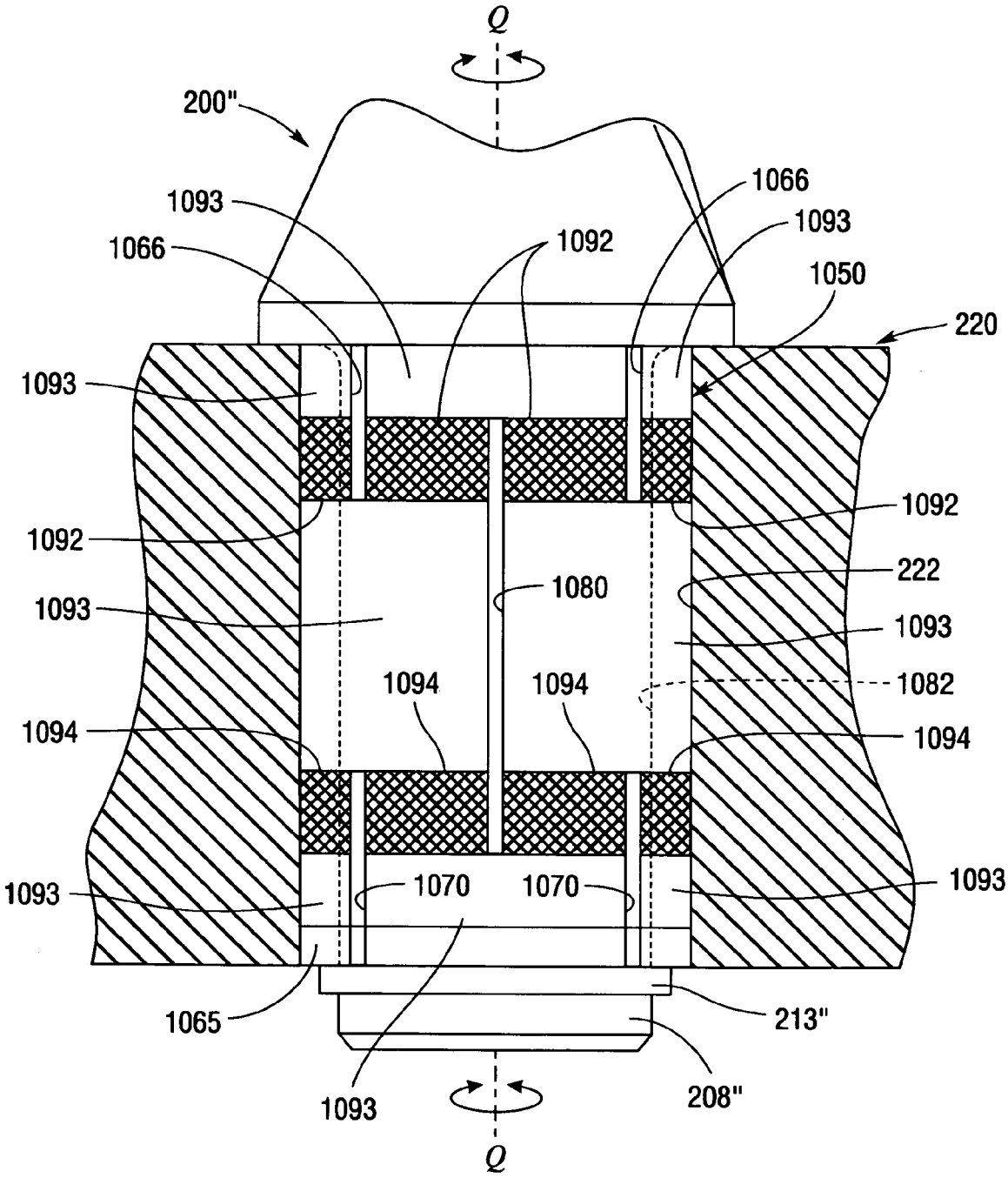
FIG. 45 is a partial cross-sectional view of the sleeve of FIGS. 41–44 installed in a support block and supporting a cutting bit therein.

FIGS. 38–40 illustrate a wear sleeve embodiment of the present invention that may be used in connection with, for example, a cutting bit 200" of the type depicted in FIG. 37 that has a cutting tip or insert 202" that is attached to a conical portion 204". The cutting insert 202" may be fabricated from hardened material (carbide or the like) and be attached to the end of the conical portion 204" by brazing or other conventional fastening methods. The conical portion 204" terminates in a contact face 205" that has a frusto-conical portion 206" protruding therefrom. An elongated shank 208" protrudes from the frusto-conical portion 206". Such conventional cutting bits 200" are known and may be retained in place by virtue of flat washer-type retention clip 213" that is inserted into an annular groove 211" in the shank 208".

FIGS. 38–40 illustrate one wear sleeve embodiment of the present invention that may be effectively used in connection with the cutting bit 200" (FIG. 37) or other conventional cutting bits that have means for retaining the bit within a sleeve or in the support block itself. Thus, the protection afforded the wear sleeve of the embodiment depicted in FIGS. 38 and 40 should not be limited to use solely in connection with cutting tools and bits that have retention means of the type depicted in FIG. 37. In this embodiment, the wear sleeve 950 may be fabricated from, for example, metal, steel, plastic, etc. and have a thickness "G". In one embodiment, for example, the wear sleeve 950 may be fabricated from 4140 steel and have a body portion 951 and an integral flange 999 on its leading end 962. The body portion 951 of the sleeve 950 is manufactured with a desired outer diameter "H" and inner diameter "I". As will be explained in further detail below, diameters "H" and "I" are the diameters of the body portion 951 of the sleeve 950 prior to its insertion into the sleeve-receiving hole 222 in the support block 220. In one embodiment, for example, the diameter "H" of the body portion 951 is larger than the inner diameter of the sleeve-receiving hole 222 in the support block. For example, in one embodiment wherein the inner diameter of the sleeve-receiving hole 222 is 1.500 inches, the diameter "H" is 1.510 inches. However, other dimensions could also be employed.

The body portion 951 of the wear sleeve 950 has an axial length "L" that is less than the length "D" of the elongated shank 208" of the cutting bit 200". See FIG. 37. In this embodiment, the sleeve 950 is further provided with at least one first notch 966 that each extend through the flange 999 and into the body portion 951 towards the trailing end 964 a first distance "M" that is less than the length "L" of the body portion 951 of the sleeve 950. Located in the body portion 951 between each first notch 966 is at least one opposed second notch 970. Each second notch 970 forms a corresponding second opening 972 a trailing end 964 of the body portion 951 of the sleeve 950 and extends towards a leading end 962 of the wear sleeve 950 a second distance "N" that is less than the length "L" of the sleeve. Thus, as can be seen in FIG. 40, the first notches 966 and the second notches 970 axially "overlap" a distance "O" in the center of the wear sleeve 950.

The wear sleeve 950 may be installed in the support block 220 by inserting the trailing end 964 of the body portion 951 into the sleeve-receiving hole 222 and applying an insertion force to the leading end 962 of the wear sleeve 950. Depending upon the material from which the wear sleeve 950 is fabricated, wear sleeve 950 may be installed by striking the integral flange 999 with a hammer or other tool until the body portion 951 is completely seated within the sleeve-receiving hole 222. The arrangement of first and second notches 966, 970 permit the wear sleeve 950 to radially contract sufficiently enough to permit the body portion 951 to be firmly seated within the sleeve-receiving hole 222 and exert radial retention forces against the wall of the sleeve-receiving hole 222 to retain the wear sleeve 950 therein. In those areas wherein the first and second notches 966 and 970 axially overlap, discrete segments of interference fit designated as 992, are established between the wear sleeve 950 and the inner wall of the sleeve-receiving hole 222. Those segments are where the greatest amount of retention forces are established. It will be understood, however, that lesser discrete segments of interference fit may be provided between the wear sleeve 950 and the sleeve-receiving hole 222 in those areas between the respective first notches 966 and those areas between the respective second notches 970 wherein the first and second notches 966, 970 do not overlap, depending upon the outer diameter of the wear sleeve 950 with respect to the inner diameter of the sleeve-receiving hole 222. Such areas of lesser interference fit are generally designed as 993 in FIG. 40 and are lesser in magnitude when compared to segments 992.

Thus, when installed in this manner, the body portion 951 of the wear sleeve 950 may be firmly retained within the sleeve-receiving hole 222. The shank 208" of the cutting bit 200" may then be inserted into the shank-receiving passage 980 in the wear sleeve 950. In one embodiment, after the wear sleeve 950 has been installed within the sleeve-receiving hole 222 as was discussed above, the inner diameter "I" of the shank-receiving passage 980 therein is larger than the diameter of the shank 208" to permit the shank 208" to freely rotate therein about its axis Q—Q.

FIGS. 41–45 illustrate another wear sleeve embodiment of the present invention that may be used in connection with, for example a cutting bit 200" of the type described above or with other cutting tools and bits that have separate retaining means for retaining the bit or tool within the support block. In this embodiment, the wear sleeve 1050 may be fabricated from, for example, metal, steel, plastic, etc. and have a thickness "G". In one embodiment, for example, the sleeve 1050 may be fabricated from 4140 or 1050 steel and have a leading end 1062 and a trailing end 1064. The sleeve 1050 has a body portion 1051 that has an outer diameter "H" and a shank-receiving passage 1082 extending therethrough that has inner diameter "I". In one embodiment, to facilitate easy installation of the wear sleeve 1050 into the sleeve-receiving hole 222 in a support block 220, the trailing end 1064 may be provided with a short pilot portion 1065 that has a diameter "H'" that is less than diameter "H" and the inner diameter of the sleeve-receiving hole 222 to facilitate easy insertion therein. As will be explained in further detail below, diameter "H" is the outer diameter of the body portion 1051 of the wear sleeve 1050 prior to its insertion into the sleeve-receiving hole 222 in the support block 220. In one embodiment, for example, the diameter "H" of the body portion 1051 is larger than the inner diameter of the sleeve-receiving hole 222 in the support block. For example, in one embodiment wherein the inner diameter of the sleeve-receiving hole 222 is 2.000 inches, the diameter "H" is 2.015 inches and the diameter "H'" is 1.995 inches. However, other dimensions could also be employed.

The body portion 1051 of the sleeve 1050 has a an axial length "L" that is less than the axial length "D" of the elongated shank 208" of the cutting bit 200". In this embodiment, the body portion 1051 of sleeve 1050 is further provided with at least one first notch 1066 that each form a corresponding first opening in the leading end of the sleeve 1050 and extend towards the trailing end 1064 a first distance "M" that is less than the length "L" of the body portion 1051 of the sleeve 1050. Also in this embodiment, a second opposed notch 1070 is axially aligned with each first notch 1066 and extends from a corresponding opening 1072 in the trailing end 1064 of the sleeve 1050 a second distance "N" that is less than the length "L" of the sleeve 1051. In one embodiment, the first and second notches 1066, 1070 do not overlap. However, at least one third notch 1080 is centrally disposed between the first notches 1066 and the second notches 1070 such that a portion of the central notch 1080 overlaps the first notches 1066 a distance "O" and also overlaps the second notches 1070 a distance "O'". In one embodiment, the distance "O" may be, for example, 0.200 inches and distance "O'" may be 0.200 inches.

The wear sleeve 1050 may be installed in the support block 220 by inserting the pilot portion 1065 of the trailing end 1064 into the sleeve-receiving hole 222 and applying an insertion force to the leading end 1062 of the wear sleeve 1050. Depending upon the material from which the sleeve 1050 is fabricated, wear sleeve 1050 may be installed by striking the leading end 1062 with a hammer or other tool until the body portion 1051 is completely seated within the sleeve-receiving hole 222. The arrangement of the first, second and third notches 1066, 1070, 1080 permit the sleeve to radially contract sufficiently enough to permit the body portion 1051 to be firmly seated within the sleeve-receiving hole 222 and exert radial retention forces against the wall of the sleeve-receiving hole 222 to retain the wear sleeve 1050 therein. In those areas wherein the first and third notches 1066 and 1080 axially overlap, first discrete segments of interference fit designated as 1092, are established between the wear sleeve 1050 and the inner wall of the sleeve-receiving hole 222. Similarly, in those areas wherein the second and third notches 1070 and 1080 axially overlap, second discrete segments of interference fit designated as 1094, are established between the wear sleeve 1050 and the inner wall of the sleeve-receiving hole 222. Those segments 1092, 1094 are where the greatest amount of retention forces may be established. It will be understood, however, that lesser discrete segments of interference fit may be provided between the wear sleeve 1050 and the sleeve-receiving hole 222 in those areas between the respective first notches 1066 and those areas between the respective second notches 1070 wherein the first and third notches 1066, 1080 do not axially overlap and those areas wherein the second and third notches 1070, 1080 do not axially overlap, depending upon the outer diameter of the wear sleeve 1050 with respect to the inner diameter of the sleeve-receiving hole 222. Such areas of lesser interference fit are generally designed as 1093 in FIG. 45 and are lesser in magnitude when compared to segments 1092.

Thus, when installed in this manner, the wear sleeve 1050 may be firmly retained within the sleeve-receiving hole 222. The shank 208" of the cutting bit 200" may then be inserted into the shank-receiving passage 1082 in the wear sleeve 1050. In one embodiment, after the wear sleeve 1050 has been installed within the sleeve-receiving hole 222 as was discussed above, the inner diameter "I" of the shank-receiving passage 1082 therein is larger than the diameter of the shank 208" to permit the shank 208" to freely rotate therein about axis Q—Q. See FIG. 45.

Figure 46:
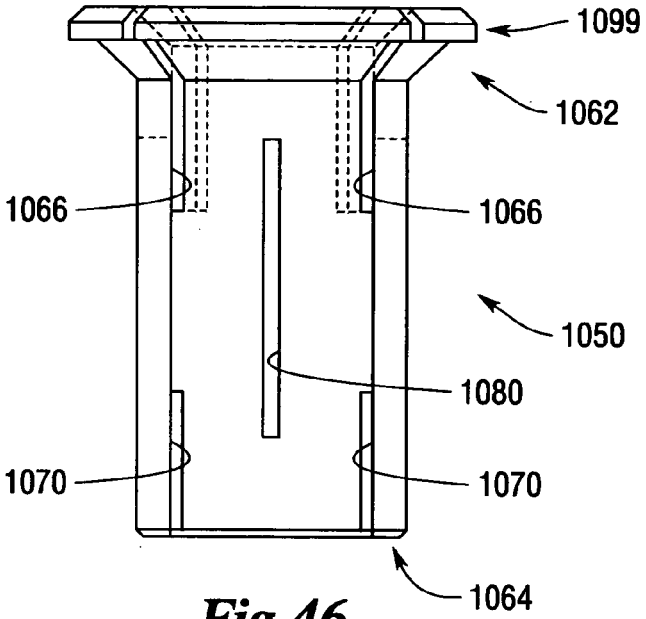
FIG. 46 is an elevational view of another sleeve embodiment of the present invention.
Figure 47:
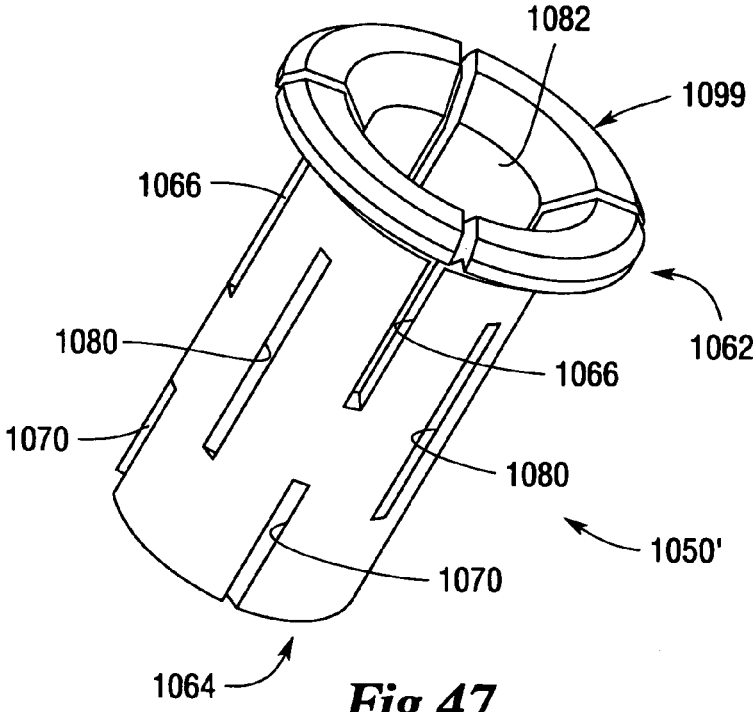
FIG. 47 is a perspective view of the sleeve embodiment of FIG. 46.
Figure 50:
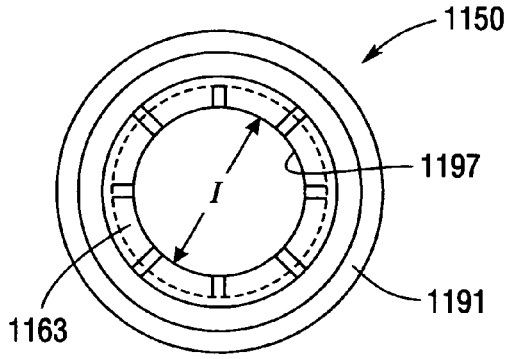
FIG. 50 is a top view of the sleeves of FIGS. 48 and 49.
Figure 48:
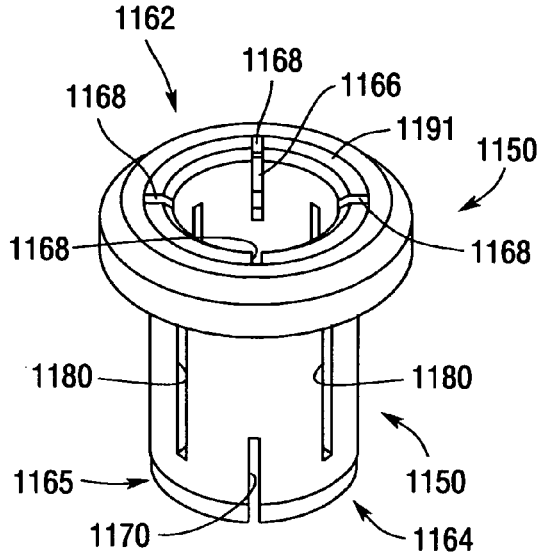
FIG. 48 is a perspective view of another sleeve embodiment of the present invention.
Figure 49:
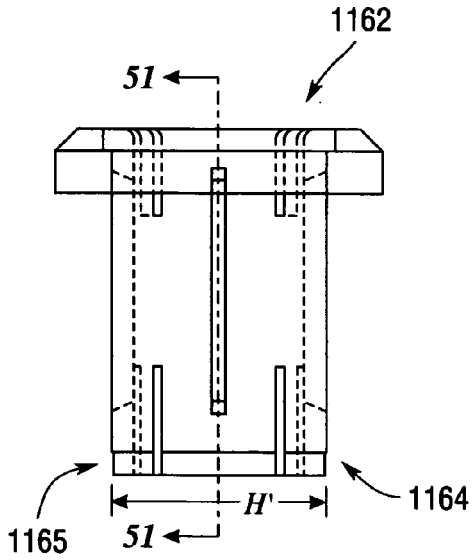
FIG. 49 is an elevational view of the sleeve of FIG. 48.

The wear sleeve embodiment depicted in FIGS. 46 and 47 is substantially identical to wear sleeve 1050 except that it has an integral wear flange 1099 formed on the leading end 1064 and it lacks the reduced diameter area 1065 for installation purposes. The reader will readily appreciate, however, that this embodiment may also include a reduced diameter area on its trailing end 1064 if desired for installation purposes. The reader will further understand that the wear sleeve 1050' is installed in such a manner such that the contact face 1098 of the flange may contact the support body 220.

Figure 51:
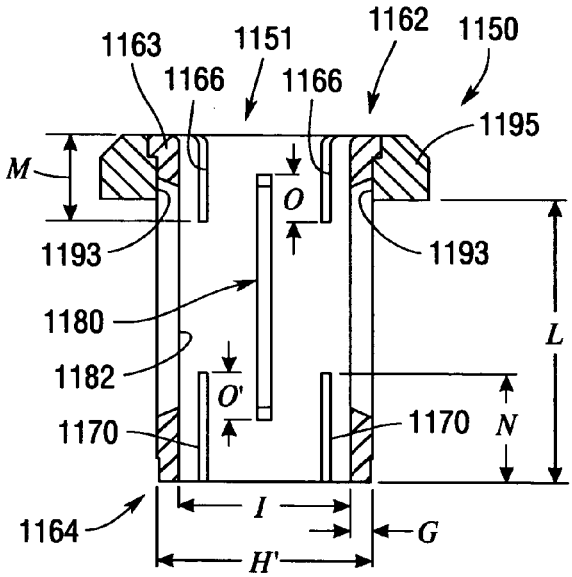
FIG. 51 is a cross-sectional view of the sleeve of FIGS. 48–50 taken along line 51—51 in FIG. 49.

Another wear sleeve embodiment of the present invention is depicted in FIGS. 48–52 that may be used in connection with, for example a cutting bit 200" of the type described above or with other cutting tools and bits that have separate retaining means for retaining the bit or tool within the support block. In this embodiment, the wear sleeve 1150 may be fabricated from, for example, metal, steel, plastic, etc. In one embodiment, for example, the sleeve 1150 may be fabricated from 4140 or 1050 steel and have a leading end 1162 and a trailing end 1164. The sleeve 1150 has a body portion 1151 that has an outer diameter "H" and a shank-receiving passage 1182 extending therethrough that has inner diameter "I". In one embodiment, to facilitate easy installation of the wear sleeve 1150 into the sleeve-receiving hole 222 in a support block 220, the trailing end 1164 may be provided with a reduced diameter portion 1165 that has a diameter "H'" that is less than diameter "H" and the inner diameter of the sleeve-receiving hole 222 to facilitate easy insertion therein This wear sleeve embodiment includes a flange 1191 that has a hole 1193 therethrough that is sized to receiving the body portion 1151 therein. To retain the flange 1191 one the body portion 1151, the leading end 1162 of the body portion 1151 is provided with a flange 1163 that is sized to be received in an annular recess 1195 in the flange 1191. The flange 1191 has a shank-receiving passage 1197 therethrough that is coaxially aligned with the shank-receiving passage 1182 in the body portion 1151 when the flange 1191 is installed on the body portion as shown in FIG. 51.

Figure 52:
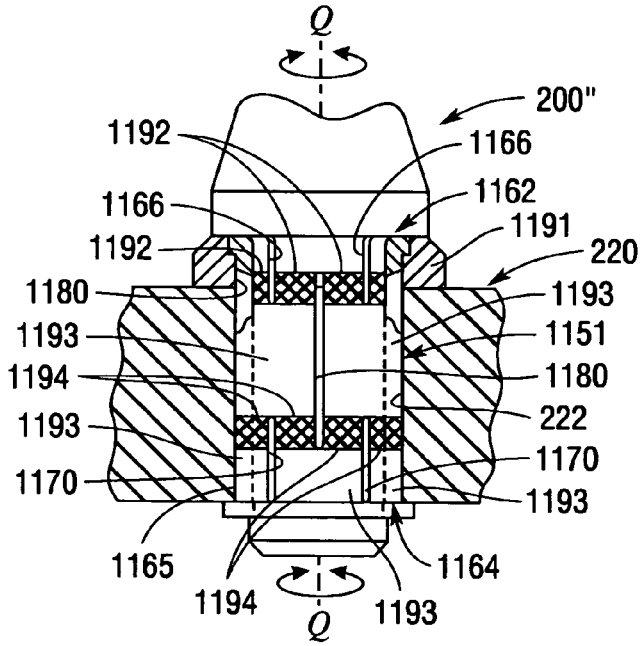
FIG. 52 is a partial cross-sectional view of the sleeve of FIGS. 48–51 installed in a support block and supporting a cutting bit therein.
Figure 53:
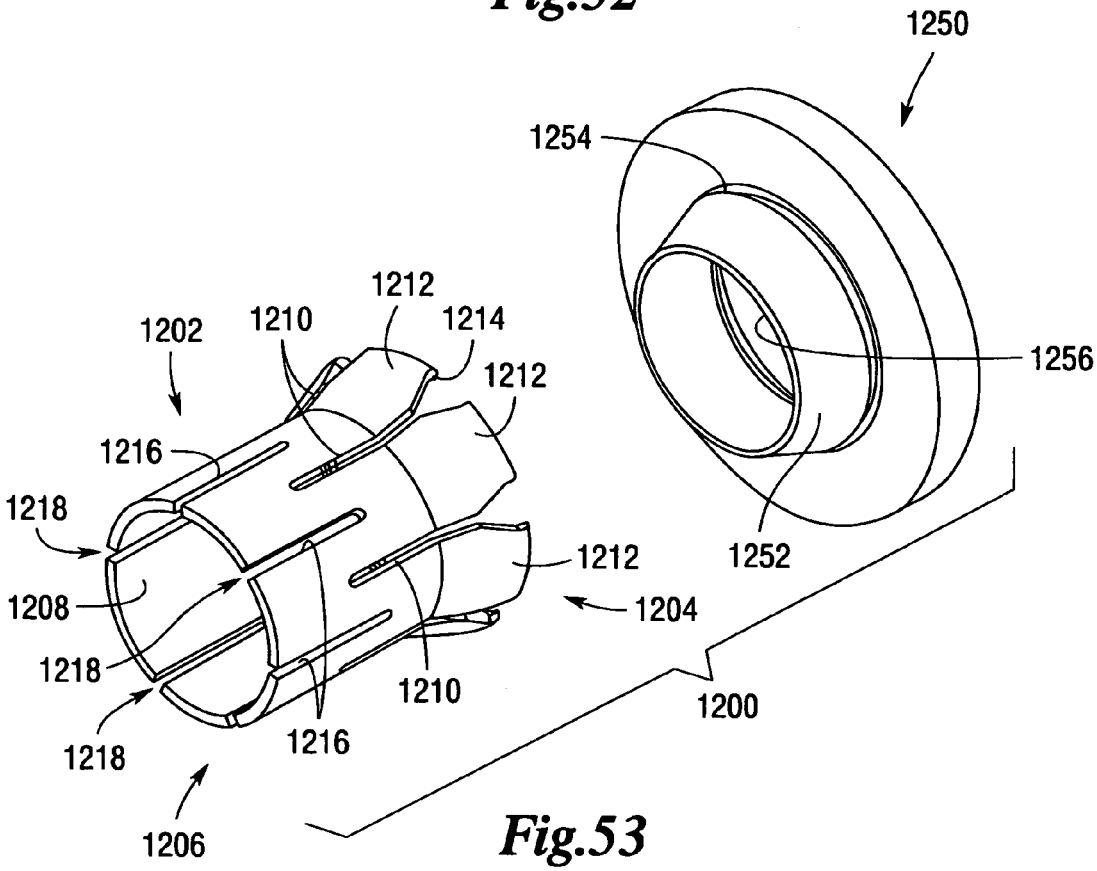
FIG. 53 is an exploded assembly view of another sleeve embodiment of the present invention.

The body portion 1151 of the wear sleeve 1050 that extends below the flange 1191 an axial length "L" that is less than the axial length "D" of the elongated shank 208" of the cutting bit 200" such that when the elongated shank 208" is installed as illustrated in FIG. 52, a portion thereof protrudes from the bottom of the wear sleeve 1050 as will be discussed in further detail below.

In this embodiment, the body portion 1151 of the wear sleeve 1150 is further provided with at least one first notch 1166 that each form a corresponding first opening 1168 in the flanged portion 1163 of the body portion 1151 and extend towards the trailing end 1164 a first distance "M" that is less than the length "L" of the body portion 1151 of the sleeve 1150. Also in this embodiment, a second notch 1170 is axially aligned with each first notch and extends from a corresponding opening 1172 in the trailing end 1164 of the sleeve 1150 a second distance "N" that is less than the length "L" of the body portion 1151. In one embodiment, the first and second notches 1166, 1170 do not overlap. However, at least one third notch 1180 is centrally disposed between the first notches 1166 and the second notches 1170 such that a portion of the central notch 1180 axially overlaps the first notches 1166 a distance "O" and also axially overlaps the second notches 1170 a distance "O'". In one embodiment, the distance "O" may be, for example, 0.300 inches and distance "O'" may be 0.300 inches.

The wear sleeve 1150 may be installed in the support block 220 as follows. The flange member is installed on the body portion 1151, by inserting the trailing end 1164 through the hole until the flanged portion 1163 of the body portion 1151 is seated or at least aligned with the received in the flange member 1191. The reduced diameter portion 1165 of the trailing end 1164 is then inserted into the sleeve-receiving hole 222 and an insertion force is applied to the leading end 1162 of the sleeve 1050. Depending upon the material from which the wear sleeve 1150 is fabricated, sleeve 1150 may be installed by striking the leading end 1162 with a hammer or other tool until the body portion sleeve 1151 is completely seated within the sleeve-receiving hole 222 and the flange is seated in the recess as shown in FIGS. 48–52. The arrangement of the first, second and third notches 1166, 1170, 1180 permit the sleeve to radially contract sufficiently enough to permit the body portion 1151 to be firmly seated within the sleeve-receiving hole 222 and exert radial retention forces against the wall of the sleeve-receiving hole 222 to retain the wear sleeve 1150 therein. In those areas wherein the first and third notches 1166 and 1180 overlap, first discrete segments of interference fit designated as 1192, are established between the wear sleeve 1150 and the inner wall of the sleeve-receiving hole 222 and also partially between the flange 1191 and the body portion 1151 to similarly retain the flange 1191 on the body portion 1151. Also, in those areas wherein the second and third notches 1170 and 1180 axially overlap, second discrete segments of interference fit designated as 1194, are established between the sleeve 1150 and the inner wall of the sleeve-receiving hole 222. Those segments 1192, 1194 are where the greatest amount of retention forces may be established. It will be understood, however, that lesser discrete segments of interference fit may be provided between the wear sleeve 1150 and the sleeve-receiving hole 222 in those areas between the respective first notches 1166 and those areas between the respective second notches 1170 wherein the first and third notches 1166, 1180 do not axially overlap and those areas wherein the second and third notches 1170, 1180 do not axially overlap, depending upon the outer diameter of the wear sleeve 1150 with respect to the inner diameter of the sleeve-receiving hole 222. Such areas of lesser interference fit are generally designed as 1193 in FIG. 52 and are lesser in magnitude when compared to segments 1192.

Thus, when installed in this manner, the wear sleeve 1150 may be firmly retained within the sleeve-receiving hole 222. The shank 208" of the cutting bit 200" may then be inserted into the coaxially aligned shank-receiving passages 1182, 1191 in the sleeve body portion 1151 and the flange 1191, respectively. In one embodiment, after the wear sleeve 1150 has been installed within the sleeve-receiving hole 222 as was discussed above, the inner diameters "I" and "I'" of the shank-receiving passages 1082,1191 is larger than the diameter of the shank 208" to permit the shank 208" to freely rotate therein about axis Q—Q. See FIG. 52. The inclusion of a separate flange 1191 provides several advantages. First, such arrangement is easier to manufacture than an embodiment wherein the flange is integral with the body. Second, if the flange or the body portion is damaged, the damaged member can be replaced without having to replace the entire sleeve. Thirdly, the flange and body portion can be made from different materials. For example, the flange may be made from very hard material and the body may be made from more resilient material.

Another two-part wear sleeve of the present invention is depicted in FIGS. 53–58 that may be used in connection with, for example a cutting bit 200" of the type described above or with other cutting tools and bits that have separate retaining means for retaining the bit or tool within the support block. In this embodiment, the two part wear sleeve 1200 has a body portion 1202 and a flanged portion 1250 that may be attached to the body portion 1202. The body portion 1202 and the flanged portion may be fabricated from for example, metal, steel, plastic, etc. In one embodiment, the body portion 1202 is fabricated from substantially planar material in a manner that is substantially similar to the manner described above with respect to retainer sleeve 250 for example. Thus, the body portion may have a first end 1203 that is brought into confronting engagement with a second end 1205. Body portion further has a leading end 1204 and a trailing end 1206. The body portion 1202 has an outer diameter "H" and a shank-receiving passage 1208 that extends therethrough. The shank-receiving passage 1208 has an inner diameter "I". As will be explained in further detail below, diameter "H" is the outer diameter of the body portion 1202 of the sleeve 1200 prior to its insertion into the sleeve-receiving hole 222' in the support block 220'. In one embodiment, for example, the diameter "H" of the body portion 1202 is larger than the inner diameter of the sleeve-receiving hole 222' in the support block 220'.

Figure 54:
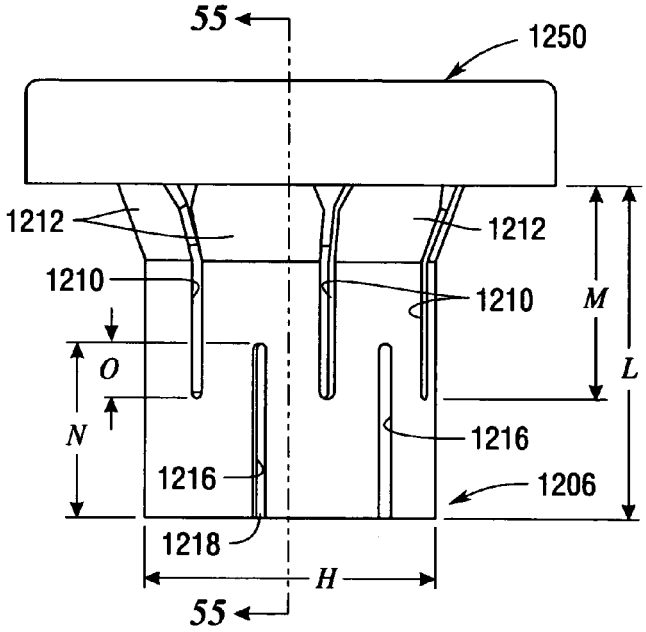
FIG. 54 is an elevational view of the sleeve of FIG. 53.
Figure 55:
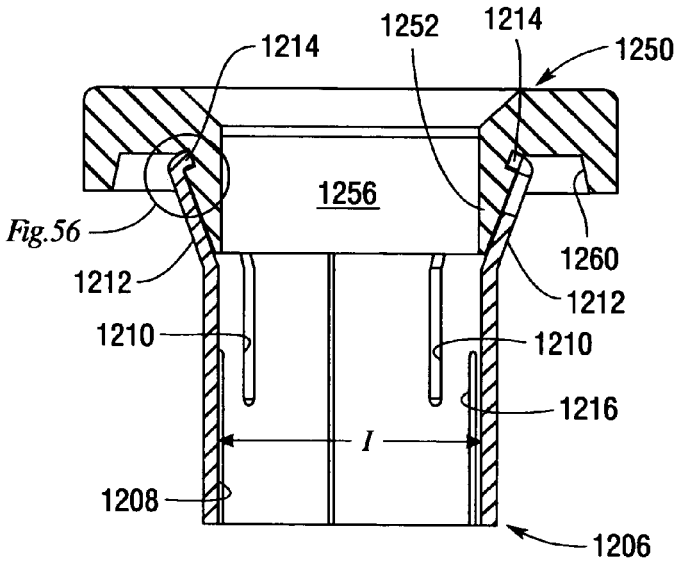
FIG. 55 is a cross-sectional view of the sleeve of FIGS. 53 and 54 taken along line 55—55 in FIG. 54.

As can be seen in FIGS. 54 and 55, a plurality of first notches 1210 are provided in the leading end 1204 of the body portion 1202 to define sleeve segments 1212. The leading end 1204 of the body portion 1202 is also tapered to be inserted over a correspondingly tapered portion 1252 of flange 1250. Each sleeve segment 1212 has a retainer hook 1214 formed thereon to be received in an annular groove 1254 adjacent the tapered portion 1252 of the flange to retain the flange 1250 on the leading end 1204 of the body portion 1202. See FIGS. 53, 55, and 56.

Figure 56:
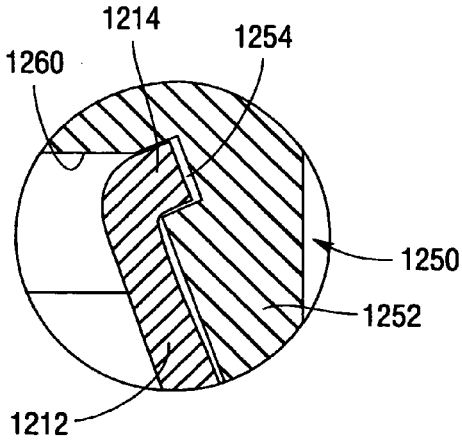
FIG. 56 is an enlarged view of a portion of the sleeve depicted in FIG. 55.
Figure 57:
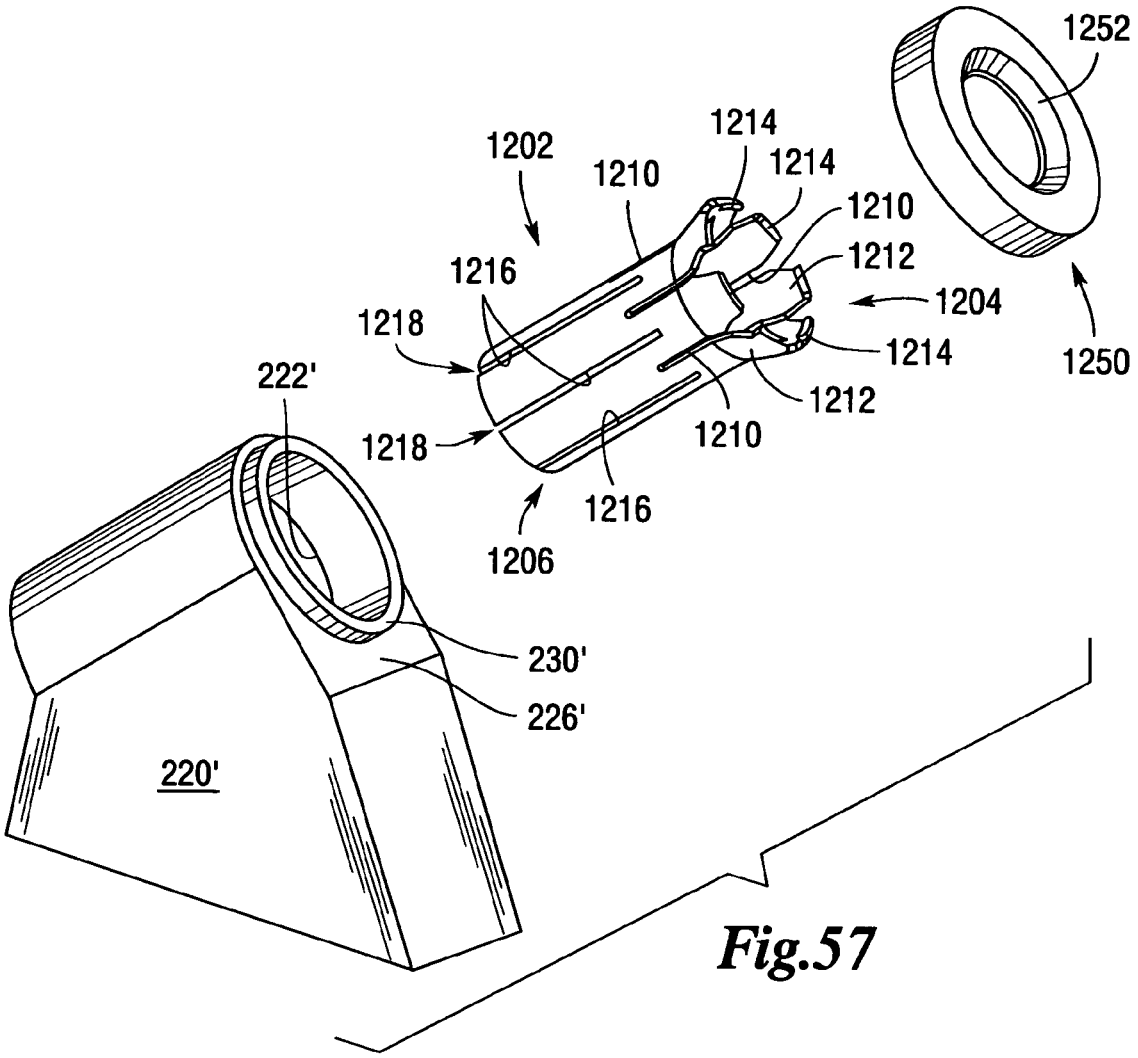
FIG. 57 is another exploded assembly view of the sleeve of FIGS. 53–56 and a support block into which the sleeve may be installed.

As can be seen in FIG. 55, the flange 1250 further has a hole 1256 therethrough that is sized to receive the shank 208' of a cutting bit 200'. When the flange 1250 is attached as shown in FIGS. 54 and 56, the hole 1256 in the flange 1250 is coaxially aligned with the shank-receiving passage 1208 in the body portion 1202. The body portion 1202 of the sleeve 1200 that extends below the tapered portion 1252 of the flange 1250 has a length "L" that is less than the length "D" of the elongated shank 208" of the cutting bit 200". In this embodiment, the first notches 1210 extend below the tapered portion 1252 of the flange 1250 a first distance "M" that is less than the length "L" of the body portion 1202 of the sleeve 1200. Also in this embodiment, at least one second notch 1216 extends from a corresponding opening 1218 in the trailing end 1206 of the body portion 1202 a second distance "N" that is less than the length "L" of the body portion 1202 and such that the first notches 1210 overlap the second notches 1216 a distance "O". In one embodiment, the distance "O" may be, for example, 0.050 inches.

Figure 58:
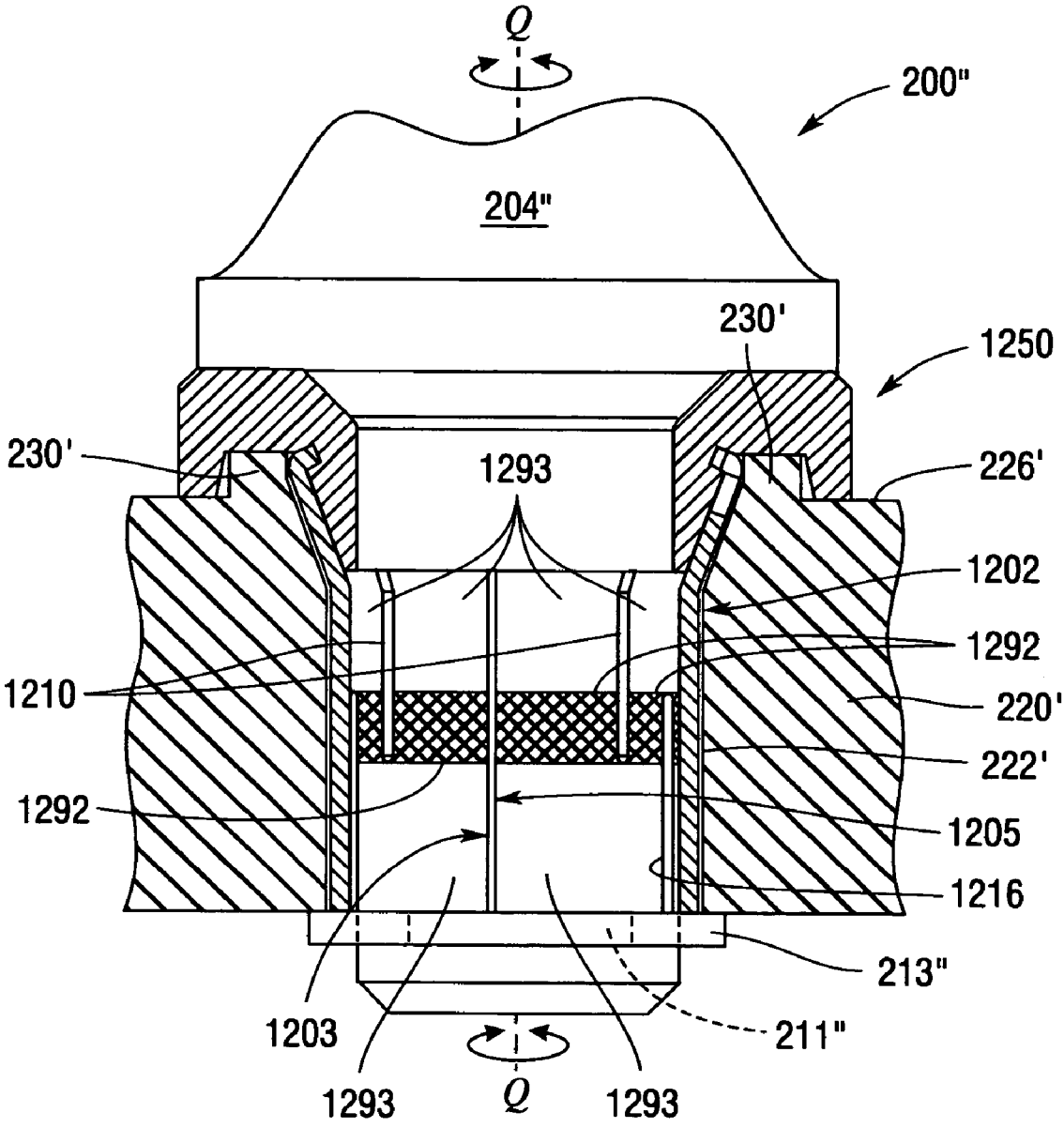
FIG. 58 is a partial cross-sectional view of the sleeve of FIGS. 53–57 installed in a support block and supporting a cutting bit therein.

Also in this embodiment, the support block 220' may be formed with an annular support ring 230' on its face 226' that is sized to be received in an annular recess 1260 provided in the flange 1250. See FIGS. 57 and 58. When installed as shown in FIG. 58, the annular ring 230' serves to retain the retaining hooks 1214 in the body member 1202 in retaining engagement with the annular groove 1254 in the flange 1250.

The wear sleeve 1200 may be installed in the support block 220' as follows. The body portion 1202 may be inserted into the sleeve-receiving hole 222' in the support block 220'. The flange member 1250 is then placed over the leading end 1204 and forced on to the body portion 1202 until the retainer hooks 1214 snap into the retaining groove 1254 on the flange 1250. The wear sleeve assembly is then hammered or otherwise pressed into the sleeve-receiving hole 222' until the annular ring 230' on the front face 226' of the support block 220' is seated in the annular groove 1260 in the flange 1250. The arrangement of the first and second notches 1210, 1216 permit the body portion 1202 of the sleeve 1200 to radially contract sufficiently enough to permit the body portion 1202 to be firmly seated within the sleeve-receiving hole 222' and exert radial retention forces against the wall of the sleeve-receiving hole 222' to retain the body portion 1202 therein. In those areas wherein the first and second notches 1210, 1216 overlap, first discrete segments of interference fit designated as 1292, are established between the sleeve 1200 and the inner wall of the sleeve-receiving hole 222'. Those segments 1292 are where the greatest amount of retention forces may be established. It will be understood, however, that lesser discrete segments of interference fit may be provided between the sleeve 1200 and the sleeve-receiving hole 222' in those areas between the respective first notches 1210 and those areas between the respective second notches 1216 wherein the first and second notches 1210, 1216 do not overlap, depending upon the outer diameter of the sleeve 1200 with respect to the inner diameter of the sleeve-receiving hole 222'. Such areas of lesser interference fit are generally designed as 1293 in FIG. 58 and are lesser in magnitude when compared to segments 1292.

Thus, when installed in this manner, the wear sleeve 1200 may be firmly retained within the sleeve receiving hole 222'. The shank 208" of the cutting bit 200" may then be inserted into the coaxially aligned shank-receiving passages 1208, 1256 in the sleeve body portion 1202 and the flange 1250, respectively. In one embodiment, after the wear sleeve 1200 has been installed within the sleeve receiving hole 222', and the bit 200" has been installed therein, a retention clip 213" or other retention means may be attached to the end of the shank 208" to retain it within the sleeve 1200. However, the shank 208" may freely rotate within the sleeve 1200 about axis Q—Q. See FIG. 58.

As with the above-described embodiment, the inclusion of a separate flange provides several advantages. First, such arrangement is easier to manufacture than an embodiment wherein the flange is integral with the body. Second, if the flange or the body portion is damaged, the damaged member can be replaced without having to replace the entire sleeve. Thirdly, the flange and body portion can be made from different materials. For example, the flange may be made from very hard material (carbide, etc.) and the body may be made from more resilient material.

Figure 59:
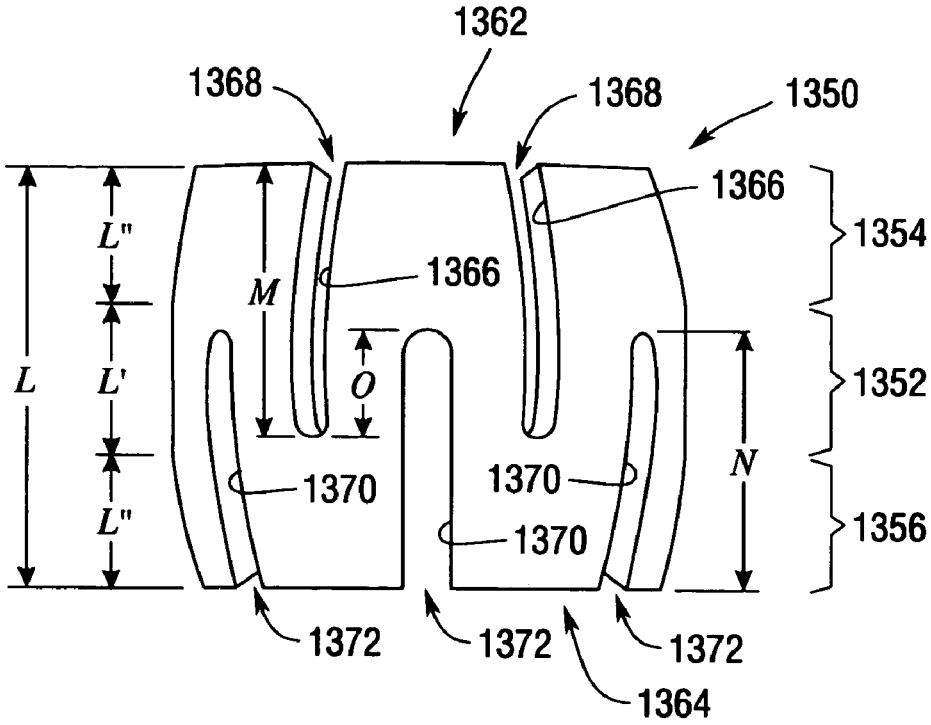
FIG. 59 is an elevational view of another sleeve embodiment of the present invention.
Figure 60:
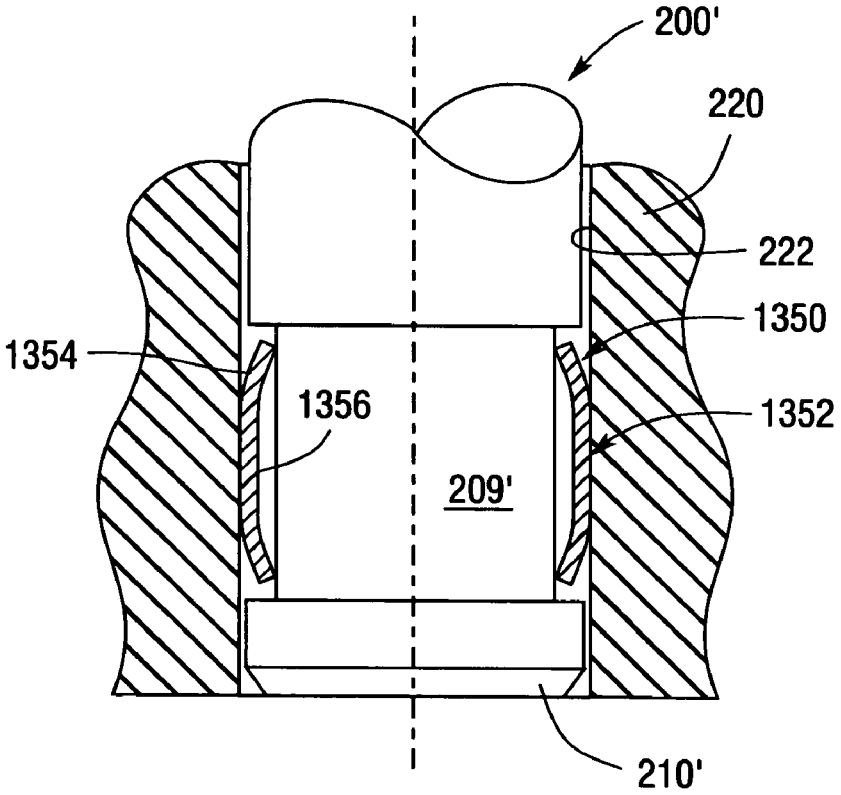
FIG. 60 is a partial cross-sectional view of the sleeve of FIG. 59 supporting a cutting bit within a support block.
Figure 61:
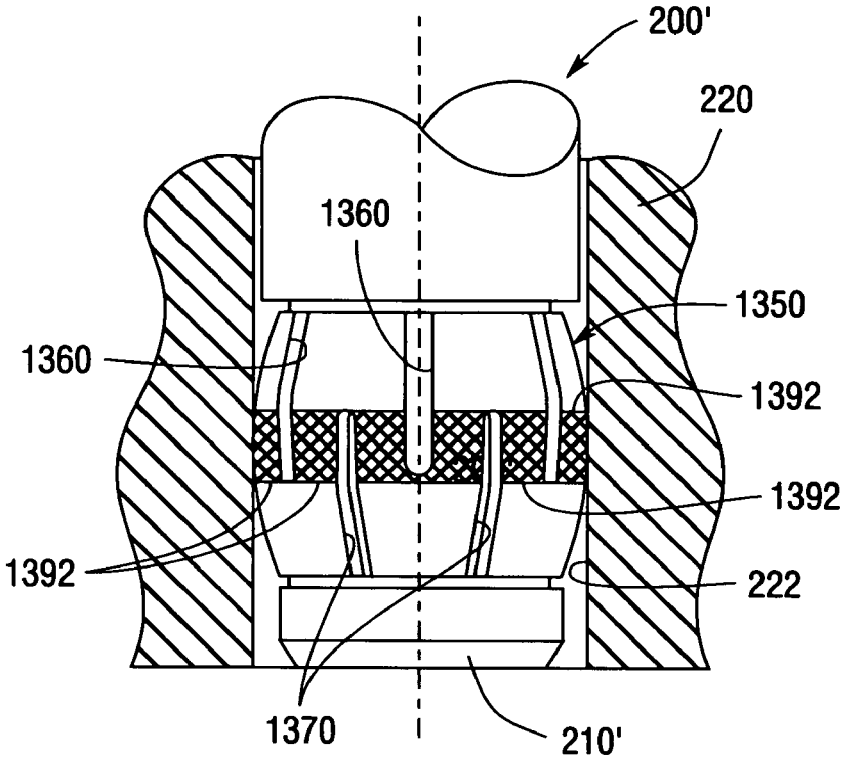
FIG. 61 is another partial cross-sectional view of the sleeve and cutting bit of FIG. 60.
Figure 62:
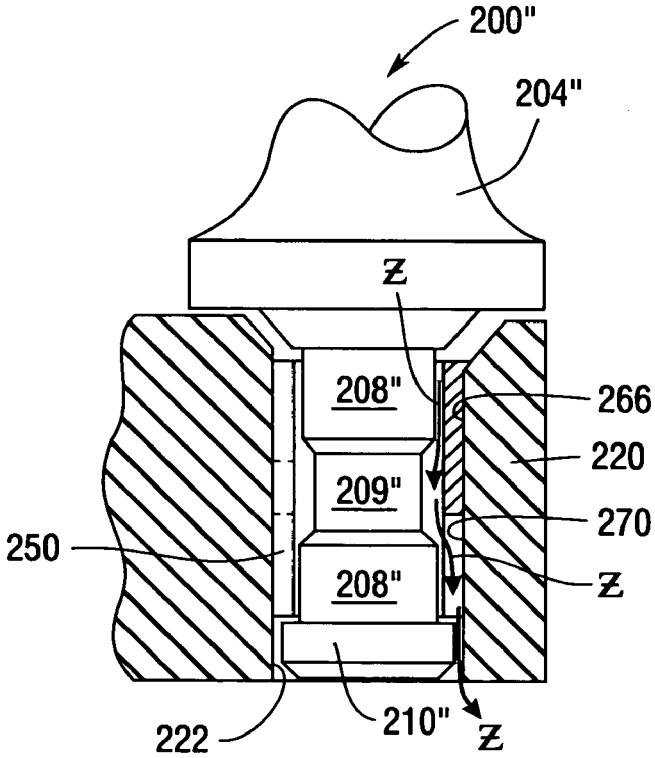
FIG. 62 is a partial cross-sectional view of a cutting bit and sleeve arrangement of another embodiment of the present invention.

FIGS. 59–61 illustrate yet another centering sleeve embodiment of the present invention. The sleeve 1350 is similar to retainer sleeve 250' discussed above. However, as can be seen in FIG. 59, sleeve 1350 has a cylindrical or straight central section 1352 and two slightly tapered end sections 1354 and 1356. In this embodiment, sleeve 1350 may be used in connection with a bit 200' of the type and construction described above (see FIG. 20) and have an overall axial length "L" that enables it to be received on the reduced diameter portion 209' of the bit 200'. In one embodiment, wherein the overall length "L" is 1.000 inch, the length of the central section 1352, designated "L'", may be 0.400 inches and the length "L"" of the tapered portions 1354 and 1356 may be 0.300 inches. See FIG. 59. The outer diameter of the central section 1352 may be, for example, 1.530 inches for use in a sleeve-receiving hole 222 that has a diameter of, for example, 1.500 inches. The ends of the tapered portions may each have an outer diameter of, for example, 1.480 inches. As with sleeve 250', the sleeve 1350 has at least one first notch 1366 that each form a corresponding first opening 1368 in the leading end 1362 and extend towards the trailing end 1364 a first distance "M" that is less than the length "L" of the retainer sleeve 1350. Located between each first notch 1366 is at least one opposing second notch 1370. Each opposing second notch 1370 forms a corresponding second opening 1372 in the trailing end 1364 of the sleeve 1350 and extends toward the leading end 1362 of the sleeve 1350 a second distance "N" that is less than the length "L" of the sleeve. Thus, as can be seen in FIG. 59, the first notches 1366 and the second notches 1370 axially "overlap" a distance "O" in the center of the sleeve 1350.

The sleeve 1350 may be installed on the reduced diameter portion 209' of the cutting bit 200' by separating the first and second ends of the sleeve to enable the shank portion 209' to be inserted therein. As can be seen in FIGS. 60 and 61 the sleeve is sized such that when installed on the shank portion 209', a gap is provided between one end of the sleeve 1350 and the end 210' and another gap is provided between the sleeve 1350 and the shank 208'. After the sleeve 1350 has been installed on the shank portion 209' of the cutting bit 200', the cutting bit assembly designated as 1390, may be installed into the sleeve-receiving hole 222 in the support block 220 by inserting the retaining flange 210 into the sleeve-receiving hole 222. Such arrangement serves to center the shank of the bit 200' within the sleeve receiving hole 222. As can be seen in FIG. 60, the areas of interference 1392 generated between the sleeve 1350 and the walls of the sleeve-receiving hole 222 will correspond to the center section of the sleeve 1352.

FIG. 61 illustrates a unique and novel cutting bit that may be used in connection with a sleeve 250 or other sleeve embodiments of the present invention. In this embodiment, the cutting bit 200" may include a cutting tip or insert that is attached to a conical portion 204". The cutting insert 202" may be fabricated from hardened material (carbide or the like) and be attached to the end of the conical portion 204" by brazing or other conventional fastening methods. An elongated shank 208" protrudes from the frusto-conical portion 206". The shank 208" has a reduced diameter portion 209" that is centrally disposed in the shank and is located such that when the shank 208" is received within the sleeve 250, the reduced diameter portion 209" corresponds to the area of overlap "O" between the first notches 266 and the second notches 270 in the sleeve. As can be seen in FIG. 61, such arrangement permits dirt and debris to pass through the notches 266, 270 and between the sleeve 250 and the reduced diameter portion 209" of the bit shank 208" as represented by arrows Z. A retainer flange 210" is formed or otherwise provided on the end of the elongated shank 208" for retaining the shank 208" within the sleeve 250 in the manner described above.

The various embodiments of the retainer systems of the present invention provide a fast and economical means for removably detaching a cutting bit to a support block of the types employed in mining operations. Various embodiments also include means for removably supporting wear sleeves in the support blocks to provide added protection to the support blocks themselves. Various embodiments of the retainer system of the present invention also afford the bit the ability to rotate within the sleeve while remaining retained therein. Such feature is desirable to permit even wearing of the cutting insert. The reader will also appreciate that the various advantages provided by the embodiments of the present invention could be successfully employed to retain a myriad of other types of cutting tools in support members without departing from the spirit and scope of the present invention.

Those of ordinary skill in the art will, of course, appreciate that various changes in the details, materials and arrangement of parts which have been herein described and illustrated in order to explain the nature of the invention may be made by the skilled artisan within the principle and scope of the invention as expressed in the appended claims.

What is claimed is:

1. A cutting tool assembly, comprising:

a support block having a sleeve-receiving hole therein;

a cutting tool having an elongated shank; and an annular sleeve having a leading end and a trailing end, said annular sleeve comprising:

at least one first notches in said annular sleeve, each said first notch extending axially from a corresponding first notch opening at the leading end and extending towards said trailing end;

at least one second opposing notch adjacent at least one said first notch, each said second notch extending from a corresponding second notch opening at said trailing end and extending axially towards said leading end of said annular sleeve, said annular sleeve forming a circumferentially extending area of interference fit with said support block when said annular sleeve is seated within said sleeve-receiving hole, said circumferentially extending area of interference fit being only interrupted by said first and second notches; and a shank-receiving passage extending through said annular sleeve for receiving said elongated shank therethrough, said annular sleeve retaining said elongated shank therein while permitting rotation of said elongated shank within said shank-receiving passage.

2. The cutting tool assembly of claim 1 wherein said annular sleeve further has a first end and a second end wherein said first and second ends may be in spaced confronting relationship to each other prior to insertion of said sleeve into said sleeve-receiving hole and wherein said first and second ends abut each other when said annular sleeve is seated in said sleeve-receiving hole.

3. The cutting tool assembly of claim 2 wherein said first and second ends are substantially parallel to each other.

4. The cutting tool assembly of claim 1 wherein said annular sleeve is fabricated from spring steel.

5. The cutting tool assembly of claim 1 wherein said annular sleeve has four first notches and three second notches.

6. The cutting tool assembly of claim 1 wherein a portion of the leading end extending between said first notches has an arcuate shape and wherein a portion of said trailing end extending between said second notches has another arcuate shape.

7. The cutting tool assembly of claim 1 wherein said annular sleeve has a flange on said leading end and wherein each said first notch extends through said flange and into a body portion of said annular sleeve.

8. The cutting tool assembly of claim 1 wherein each said first notch opening has chamfered portions and wherein each said second notch opening has chamfered portions.

9. The cutting tool assembly of claim 1 wherein at least one said first notch tapers from said first opening towards said trailing end, such that a width of said first notch adjacent said leading end is greater than a width of said first notch adjacent a trailing end.

10. The cutting tool assembly of claim 9 wherein at least one said second notch tapers from said second opening towards said leading end, such that a width of said second notch adjacent said trailing end is greater than a width of said notch adjacent said leading end.

11. The cutting tool assembly of claim 1 further comprising a retainer flange formed on an end of said elongated shank, said retainer flange having a diameter that is greater than a diameter of said annular sleeve when said annular sleeve is seated in said sleeve-receiving hole in said support block.

12. The cutting tool assembly of claim 1 wherein an end of each one of said at least one first notches extends beyond an end of at least one of said second notches.

13. The cutting tool assembly of claim 12 wherein the end of each first notch extends beyond the ends of said second notches an overlap distance to define a longitudinal width of said circumferentially extending area of interference.

14. The cutting tool assembly of claim 1 wherein said leading end has a first outer diameter and said trailing end has a second outer diameter that is less than said first outer diameter.

15. The cutting tool assembly of claim 1 wherein said annular sleeve comprises:

a cylindrical center section;

a first tapered portion protruding from said cylindrical center section; and a second tapered portion protruding from said cylindrical center section.

16. The cutting tool assembly of claim 1 wherein said at least one first notch comprises:

at least two first notches in said annular sleeve and wherein said at least one second opposing notch comprises:

a second opposing notch corresponding to each said first notch and being axially aligned therewith to define a pair of axially aligned first and second notches, each said second notch extending from a corresponding second notch opening at said trailing end and extending axially towards said corresponding first notch to define a central portion of said sleeve therebetween and wherein said cutting tool assembly further comprises a third notch between each said pair of axially aligned first and second notches for establishing at least two discrete partially arcuate segments of interference fit between said annular wear sleeve and said support block when said annular wear sleeve is seated within said sleeve-receiving hole, said annular wear sleeve further having a shank-receiving passage for receiving said elongated shank therethrough while permitting rotation of said elongated shank therein; and a retention member attachable to an end of said elongated shank to retain said elongated shank within said shank-receiving passage in said sleeve.

17. The cutting tool assembly of claim 16 wherein said annular sleeve has four first notches, four second notches and four third notches.

18. The cutting tool assembly of claim 16 wherein said annular sleeve has a flange on said leading end and wherein each said first notch extends through said flange and into a body portion of said annular sleeve.

19. The cutting tool assembly of claim 16 wherein ends of said third notches extend beyond ends of said first and second notches to define portions of said sleeve therebetween that establish at least one upper set of the at least two discrete partially arcuate upper segments of interference fit between said annular sleeve and said support block when said annular sleeve is seated within said sleeve-receiving hole and at least one lower set of at least two discrete, partially arcuate lower segments of interference fit between said annular sleeve and said support block when said annular sleeve is seated within said sleeve-receiving hole.

20. The cutting tool assembly of claim 16 wherein an upper end of each said third notch extends beyond the ends of said first notches a first overlap distance to define a first width of each said upper set of discrete partially arcuate segments of interference and wherein a lower end of each said third notch extends beyond the ends of said second notches to define a second width of each said upper set of discrete partially arcuate segments of interference.

21. The cutting tool assembly of claim 16 wherein said leading end has a first diameter and said trailing end has a second diameter that is less than the first diameter.

22. The cutting tool assembly of claim 1 wherein said sleeve has a body portion having a flanged leading end and wherein said at least one first notch comprises:

at least two first notches in said body portion and wherein said at least one second opposing notch comprises:

a second opposing notch in said body portion between each said first notches, each said second notch extending from a corresponding second notch opening at said trailing end and extending axially towards said leading end of said body portion and wherein said sleeve further comprises:

an outer flange having a hole therethrough for receiving the body portion therethrough, said outer flange having a recess therein for receiving the flanged leading end of said body portion therein; and a retention member attachable to an end of said elongated shank to retain said elongated shank within said shank-receiving passage in said sleeve.

23. The cutting tool assembly of claim 1 wherein said at least one first notch comprises:

at least two first notches and wherein at least one of said at least one second opposing notches is between each said first notches, and wherein said annular sleeve further comprises:

a flange member attached to said leading end of said body portion.

24. The cutting tool assembly of claim 23 wherein said annular sleeve further comprises:

an annular groove in said flange member; and a plurality of retainer hooks formed on said leading end of said body portion for retaining engagement with said annular groove in said flange member.

25. The cutting tool assembly of claim 23 wherein said flange member has a tapered portion protruding therefrom and wherein said leading end of said body portion is configured to receive the tapered portion of said flange member therein.

26. A cutting tool assembly, comprising:

a support block having a sleeve-receiving hole therein;

a cutting tool having an elongated shank comprising a first shank portion having a first diameter, a second shank portion having a second diameter that is less than the first diameter of the first shank portion, and an end portion having the first diameter and oriented such that said second shank portion is between said first shank portion and said end portion; and an annular sleeve sized to be received on said second shank portion between said first shank portion and said end portion of said cutting tool, said annular sleeve further having a plurality of axially extending notches therein for establishing a circumferentially extending area of interference fit between said sleeve and said support block when said annular sleeve is seated within said sleeve-receiving hole, said circumferentially extending area of interference fit being interrupted only by said plurality of axially extending notches, said annular sleeve defining a shank-receiving passage for receiving said second shank portion therethrough sized to permit said second shank portion to rotate therein while retaining said elongated shank within said shank-receiving passage.

27. The cutting tool assembly of claim 26, wherein said annular sleeve has a leading end and a trailing end and wherein said sleeve further comprises:

at least two first notches in said annular sleeve, each said first notch extending axially from a corresponding first notch opening at the leading end and extending towards said trailing end; and a second opposing notch between each said first notches, each said second notch extending from a corresponding second notch opening at said trailing end and extending axially towards said leading end of said annular sleeve.

28. The cutting tool assembly of claim 26 wherein said annular sleeve further has a first end and a second end wherein said first and second ends may be in spaced confronting relationship to each other prior to insertion of said sleeve into said sleeve-receiving hole and wherein said first and second ends abut each other when said annular sleeve is seated in said sleeve-receiving hole.

29. The cutting tool assembly of claim 28 wherein said first and second ends are substantially parallel to each other.

30. The cutting tool assembly of claim 26 wherein said annular sleeve has four first notches and three second notches.

31. The cutting tool assembly of claim 26 wherein a portion of the leading edge extending between said first notches has an arcuate shape and wherein a portion of said trailing end extending between said second notches has another arcuate shape.

32. The cutting tool assembly of claim 27 wherein ends of said first notches extend beyond ends of said second notches.

33. The cutting tool assembly of claim 32 wherein the end of each first notch extends beyond the ends of said second notches an overlap distance to define a longitudinal width of said circumferentially extending area of interference.

34. The cutting tool assembly of claim 26 further comprising:

a retention member attachable to said end portion of said elongated shank to retain said elongated shank within said shank-receiving passage in said wear sleeve.

35. The cutting tool assembly of claim 34, wherein said annular sleeve has a leading end and a trailing end and wherein at least some of said plurality of axially extending notches comprises:

at least two first notches in said annular sleeve, each said first notch extending axially from a corresponding first notch opening at the leading end and extending towards said trailing end; and a second opposing notch between each said first notches, each said second notch extending from a corresponding second notch opening at said trailing end and extending axially towards said leading end of said annular wear sleeve.

36. The cutting tool assembly of claim 34 wherein said annular sleeve has four first notches and four second notches.

37. The cuffing tool assembly of claim 35 wherein said annular sleeve has a flange on said leading end and wherein each said first notch extends through said flange and into a body portion of said annular sleeve.

38. The cutting tool assembly of claim 35 wherein ends of said first notches extend beyond ends of said second notches to define portions of said arcuate sleeve therebetween that establish the at least two discrete partially arcuate segments of interference fit between said annular sleeve and said support block when said annular sleeve is seated within said sleeve-receiving hole.

39. The cutting tool assembly of claim 38 wherein the ends of each first notch extend beyond the ends of said second notches an overlap distance to define a width of each said discrete partially arcuate segments of interference.

40. The cutting tool assembly of claim 26 wherein said annular sleeve comprises:

a body portion having a leading end and a trailing end, the leading end having a flange formed thereon and said plurality of axially extending notches comprises:

at least two first notches in said body portion, each said first notch extending axially from the flange towards said trailing end;

a second opposing notch in said body portion corresponding to each said first notch and being axially aligned therewith to define a pair of axially aligned first and second notches, each said second notch extending from a corresponding second notch opening at said trailing end and extending axially towards said corresponding first notch to define a central portion of said body portion therebetween;

a third notch in said body portion between each said pair of axially aligned first and second notches for establishing at least two discrete partially arcuate segments of interference fit between said body portion and the support block when said body portion is seated within a sleeve-receiving hole in the support block;

a shank-receiving passage in said body portion for receiving said elongated shank therethrough while permitting rotation of said elongated shank therein; and an outer flange having a hole therethrough for receiving the body portion therethrough, said outer flange having a recess therein for receiving the flanged end of said body portion therein.

41. The cutting tool assembly of claim 40 wherein ends of said third notches extend beyond ends of said first and second notches to define portions of said sleeve therebetween that establish at least one upper set of the at least two discrete partially arcuate upper segments of interference fit between said body portion and said outer flange and at least one lower set of at least two discrete, partially arcuate lower segments of interference fit between said annular sleeve and the support block when said annular sleeve is seated within the sleeve-receiving hole in the support block.

42. The cutting tool assembly of claim 41 wherein said upper set of at least two discrete partially arcuate upper segments of interference fit also extend between said body portion and said support block when said annular sleeve is seated within the sleeve-receiving hole in the support block.

43. The cutting tool assembly of claim 26 wherein said sleeve has a a body portion having a flanged leading end and a trailing end and wherein at least some of said plurality of axially extending notches comprise:

at least two first notches in said body portion and extending axially from the flange towards said trailing end;

a second opposing notch in said body portion corresponding to each said first notch and being axially aligned therewith to define a pair of axially aligned first and second notches, each said second notch extending from a corresponding second notch opening at said trailing end and extending axially towards said corresponding first notch to define a central portion of said body portion therebetween;

a third notch in said body portion between each said pair of axially aligned first and second notches for establishing at least two discrete partially arcuate segments of interference fit between said body portion and the support block when said body portion is seated within a sleeve-receiving hole in the support block and wherein said cutting tool assembly further comprises:

an outer flange having a hole therethrough for receiving the body portion therethrough, said outer flange having a recess therein for receiving the flanged end of said body portion therein; and a retention member attachable to an end of said elongated shank to retain said elongated shank within said shank-receiving passage in said sleeve.

44. The cutting tool assembly of claim 43 wherein ends of said third notches extend beyond ends of said first and second notches to define portions of said sleeve therebetween that establish at least one upper set of the at least two discrete partially arcuate upper segments of interference fit between said body portion and said outer flange and at least one lower set of at least two discrete, partially arcuate lower segments of interference fit between said annular sleeve and the support block when said annular wear sleeve is seated within the sleeve-receiving hole in the support block.

45. The cutting tool assembly of claim 44 wherein said upper set of at least two discrete partially arcuate upper segments of interference fit also extend between said body portion and said support block when said annular sleeve is seated within the sleeve-receiving hole in the support block.

46. The cutting tool assembly of claim 35 wherein said support block has a contact face and wherein said annular sleeve further comprises a flange member attached to said leading end of said body portion for contact with said contact face of said support block.

47. The cutting tool assembly of claim 46 further comprising at least one retention member on said leading end of said body portion for retaining engagement with a portion of said flange member.

48. The cutting tool assembly of claim 46 further comprising:

an annular groove in said flange member:

a plurality of retainer hooks formed on said leading end of said body portion for retaining engagement with said annular groove in said flange member.

49. The cutting tool assembly of claim 46 wherein said flange member has a tapered portion protruding therefrom and wherein said leading end of said body portion is configured to receive the tapered portion of said flange member therein.

50. A cutting tool assembly, comprising:

a support block having a sleeve-receiving hole therein;

a cutting tool having an elongated shank and an end portion; and a sleeve comprising:

a flange;

a body portion protruding from said flange, said body portion having a plurality of axially extending notches therein for establishing a circumferentially extending area of interference fit between said body portion and said support block when said body portion is seated within said sleeve-receiving hole, said circumferentially extending area of interference fit being interrupted only by said plurality of axially extending notches, said sleeve having a shank-receiving passage for receiving said elongated shank therethrough, said body portion having a tapered retaining end for retainingly engaging said end portion of said elongated shank while permitting rotation of said elongated shank within said shank-receiving passage.

51. The cutting tool assembly of claim 50, wherein said sleeve further comprises:

at least two first notches extending through said flange and into said body portion, each said first notch extending axially in said body portion from the flange towards said tapered retaining end; and a second opposing notch between each said first notches, each said second notch extending from a corresponding second notch opening at said tapered retaining end and extending axially towards said flange.

52. The cutting tool assembly of claim 50 wherein said sleeve further has a first end and a second end wherein said first and second ends are in spaced confronting relationship to each other prior to insertion of said body portion of said sleeve into said sleeve-receiving hole and wherein said first and second ends abut each other when said sleeve is seated in said sleeve-receiving hole.

53. The cutting tool assembly of claim 51 wherein ends of said first notches extend beyond ends of said second notches to define portions of said body portion therebetween that establish the at least two discrete partially arcuate segments of interference fit between said body portion and said support block when said body portion is seated within said sleeve-receiving hole.

54. The cutting tool assembly of claim 53 wherein the ends of each first notch extend beyond the ends of said second notches an overlap distance to define a width of each said discrete partially arcuate segments of interference.

55. The cutting tool assembly of claim 1 wherein said sleeve has a body portion having a cylindrical center section, a first tapered portion protruding from said cylindrical center section and a second taper portion protruding from said cylindrical center section, said first tapered portion terminating in a leading end and said second tapered portion terminating in a trailing end and wherein said at least one first notch comprises at least two first notches in said body portion, each said first notch extending axially from a corresponding first notch opening at the leading end and terminating in said cylindrical center section and wherein said at least one second opposing notch is between each said first notches.

56. A cutting tool assembly, comprising:

a support block having a sleeve-receiving hole therethrough;

a cutting tool having an elongated shank that has a reduced diameter portion therein; and an annular sleeve having a leading end and a trailing end, said annular sleeve comprising:

at least two first notches in said annular sleeve, each said first notch extending axially from a corresponding first notch opening at the leading end and extending towards said trailing end;

a second opposing notch between each said first notches, each said second notch extending from a corresponding second notch opening at said trailing end and extending axially towards said leading end of said annular sleeve, said first and second notches axially overlapping each other to form an area of overlap to establish at least two discrete partially arcuate segments of interference fit between said sleeve and said support block when said annular sleeve is seated within said sleeve-receiving hole and wherein; and a shank-receiving passage extending through said annular sleeve for receiving said elongated shank therethrough, said annular sleeve retaining said elongated shank therein while permitting rotation of said elongated shank within said shank-receiving passage and wherein said reduced diameter portion of said elongated shank coincides with said area of overlap to permit passage of debris from the shank-receiving passage through at least one of said first and second notches.

* * * * *